US011357279B2

(12) United States Patent
Cotterman

(10) Patent No.: US 11,357,279 B2
(45) Date of Patent: Jun. 14, 2022

(54) CLOSURE COMPONENTS FOR A HELMET LAYER AND METHODS FOR INSTALLING SAME

(71) Applicant: Boa Technology Inc., Denver, CO (US)

(72) Inventor: Jesse Cotterman, Evergreen, CO (US)

(73) Assignee: Boa Technology Inc., Denver, CO (US)

( * ) Notice: Subject to any disclaimer, the term of this patent is extended or adjusted under 35 U.S.C. 154(b) by 579 days.

(21) Appl. No.: 15/975,606

(22) Filed: May 9, 2018

(65) Prior Publication Data

US 2018/0325203 A1 Nov. 15, 2018

Related U.S. Application Data

(60) Provisional application No. 62/503,866, filed on May 9, 2017.

(51) Int. Cl.
*A42B 3/04* (2006.01)
*A42B 3/08* (2006.01)
(Continued)

(52) U.S. Cl.
CPC ..... *A42B 3/0406* (2013.01); *A42B 3/06* (2013.01); *A42B 3/064* (2013.01); *A42B 3/08* (2013.01);
(Continued)

(58) Field of Classification Search
CPC ..... A42B 3/0406; A42B 3/06; A42B 3/064; A42B 3/08; A42B 3/12; A42B 3/145;
(Continued)

(56) References Cited

U.S. PATENT DOCUMENTS 59,332 A 10/1866 White et al.
80,834 A 8/1868 Prussia
(Continued)

FOREIGN PATENT DOCUMENTS

CA 2112789 8/1994
CA 2114387 8/1994
(Continued)

OTHER PUBLICATIONS

U.S. Appl. No. 09/956,601 Including its prosecution history, filed Sep. 18, 2001, Hammerslag.
(Continued)

*Primary Examiner* — F Griffin Hall
*Assistant Examiner* — Griffin Hall
(74) *Attorney, Agent, or Firm* — Kilpatrick Townsend & Stockton, LLP

(57) ABSTRACT

A protective component for a helmet includes a liner or shell that is coupleable with the helmet so that the liner or shell is positioned on an interior surface of the helmet. The liner or shell is made of a low-friction material and is coupled with the helmet so that the liner or shell is moveable relative to the helmet in response to a force being exerted on the helmet. A rear support member is removably coupled with the liner or shell and a tightening mechanism is attached to the rear support member. The tightening mechanism is configured to tension a tension member and thereby tighten the liner or shell, and the helmet, about the wearer's head.

21 Claims, 16 Drawing Sheets

(51) Int. Cl.
*A42B 7/00* (2006.01)
*A42B 3/12* (2006.01)
*A42B 3/06* (2006.01)
*A42B 3/14* (2006.01)

(52) U.S. Cl.
CPC ..... *A42B 3/12* (2013.01); *A42B 3/145* (2013.01); *A42B 7/00* (2013.01)

(58) Field of Classification Search
CPC ..... A42B 3/14; A42B 3/142; A42B 3/063; A42B 3/085; A42B 3/10; A42B 7/00; A42B 1/069; A42B 1/22
USPC .... 2/410, 411, 416, 417, 418, 419, 420, 183
See application file for complete search history.

(56) References Cited

U.S. PATENT DOCUMENTS 117,530 A 8/1871 Foote
228,946 A 6/1880 Schulz
230,759 A 8/1880 Drummond
301,854 A 7/1884 Buch
371,394 A 10/1887 Warren
379,113 A 3/1888 Hibberd
460,743 A 10/1891 Dickson, Jr.
746,563 A 12/1903 McMahon
819,993 A 5/1906 Haws et al.
886,779 A 5/1908 Dunstan
908,704 A 1/1909 Sprinkle
1,060,422 A 4/1913 Bowdish
1,062,511 A 5/1913 Short
1,083,775 A 1/1914 Thomas
1,090,438 A 3/1914 Worth et al.
1,170,472 A 2/1916 Barber
1,288,859 A 12/1918 Feller et al.
1,390,991 A 9/1921 Fotchuk
1,393,188 A 10/1921 Whiteman
1,412,486 A 4/1922 Paine
1,416,203 A 5/1922 Hobson
1,429,657 A 9/1922 Trawinski
1,466,673 A 9/1923 Solomon et al.
1,469,661 A 10/1923 Tosuke
1,481,903 A 1/1924 Hart
1,502,919 A 7/1924 Seib
1,505,430 A 8/1924 Roberts
1,530,713 A 3/1925 Clark
1,548,407 A 8/1925 Chisholm
1,862,047 A 6/1932 Boulet et al.
1,995,243 A 3/1935 Clarke
2,088,851 A 8/1937 Gantenbein
2,109,751 A 3/1938 Matthias et al.
2,124,310 A 7/1938 Murr, Jr.
2,316,102 A 4/1943 Preston
2,500,622 A 3/1950 Aho
2,539,026 A 1/1951 Mangold
2,611,940 A 9/1952 Cairns
2,636,237 A 4/1953 Price
2,673,381 A 3/1954 Dueker
2,893,090 A 7/1959 Pagoda
2,907,086 A 10/1959 Ord
2,926,406 A 3/1960 Zahnor et al.
2,991,523 A 7/1961 Conte
3,028,602 A 4/1962 Miller
3,035,319 A 5/1962 Wolff
D193,807 S 10/1962 Stanley
3,106,003 A 10/1963 Herdman
3,112,545 A 12/1963 Williams
3,122,810 A 3/1964 Lawrence et al.
3,163,900 A 1/1965 Martin
D200,394 S 2/1965 Hakim
3,169,325 A 2/1965 Fesl
3,193,950 A 7/1965 Liou
3,197,155 A 7/1965 Chow
3,214,809 A 11/1965 Zahnor
3,221,384 A 12/1965 Aufenacker
3,276,090 A 10/1966 Nigon
D206,146 S 11/1966 Hendershot
3,345,707 A 10/1967 Rita
D210,649 S 4/1968 Getgay
3,401,437 A 9/1968 Christpohersen
3,430,303 A 3/1969 Perrin et al.
3,445,901 A 5/1969 Helmut
3,491,465 A 1/1970 Martin
3,545,106 A 12/1970 Martin
3,618,232 A 11/1971 Shnuriwsky
3,668,791 A 6/1972 Salzman et al.
3,678,539 A 7/1972 Graup
3,703,775 A 11/1972 Gatti
3,729,779 A 5/1973 Porth
3,738,027 A 6/1973 Schoch
3,793,749 A 2/1974 Gertsch et al.
3,808,644 A 5/1974 Schoch
3,845,575 A 11/1974 Boden
3,934,346 A 1/1976 Sasaki et al.
3,975,838 A 8/1976 Martin
4,084,267 A 4/1978 Zadina
4,130,949 A 12/1978 Seidel
4,142,307 A 3/1979 Martin
4,227,322 A 10/1980 Annovi
4,261,081 A 4/1981 Lott
4,267,622 A 5/1981 Burnett-Johnston
RE31,052 E 10/1982 Adams
4,394,803 A 7/1983 Goldstein
4,408,403 A 10/1983 Martin
4,417,703 A 11/1983 Weinhold
4,433,456 A 2/1984 Baggio
4,452,405 A 6/1984 Adomeit
4,463,761 A 8/1984 Pols et al.
4,480,395 A 11/1984 Schoch
4,507,878 A 4/1985 Semouha
4,516,576 A 5/1985 Kirchner
4,551,932 A 11/1985 Schoch
4,553,342 A 11/1985 Derderian et al.
4,555,830 A 12/1985 Petrini et al.
4,574,500 A 3/1986 Aldinio et al.
4,616,432 A 10/1986 Bunch et al.
4,616,524 A 10/1986 Biodia
4,619,057 A 10/1986 Sartor et al.
4,620,378 A 11/1986 Sartor
4,631,839 A 12/1986 Bonetti et al.
4,631,840 A 12/1986 Gamm
4,633,599 A 1/1987 Morell et al.
4,644,938 A 2/1987 Yates et al.
4,654,985 A 4/1987 Chalmers
4,660,300 A 4/1987 Morell et al.
4,660,302 A 4/1987 Arieh et al.
4,680,878 A 7/1987 Pozzobon et al.
4,719,670 A 1/1988 Kurt
4,719,709 A 1/1988 Vaccari
4,719,710 A 1/1988 Pozzobon
4,722,477 A 2/1988 Floyd
4,741,115 A 5/1988 Pozzobon
4,748,726 A 6/1988 Schoch
4,760,653 A 8/1988 Baggio
4,780,969 A 11/1988 White, Jr.
4,787,124 A 11/1988 Pozzobon et al.
4,790,081 A 12/1988 Benoit et al.
4,796,829 A 1/1989 Pozzobon et al.
4,799,297 A 1/1989 Baggio et al.
4,802,291 A 2/1989 Sartor
4,811,503 A 3/1989 Iwama
4,826,098 A 5/1989 Pozzobon et al.
4,841,649 A 6/1989 Baggio et al.
4,856,207 A 8/1989 Datson
4,862,878 A 9/1989 Davison
4,870,723 A 10/1989 Pozzobon et al.
4,870,761 A 10/1989 Tracy
4,884,760 A 12/1989 Baggio et al.
4,901,938 A 2/1990 Cantley et al.
4,924,605 A 5/1990 Spademan
D308,282 S 6/1990 Bergman et al.
4,937,953 A 7/1990 Walkhoff
4,961,544 A 10/1990 Biodia
4,974,299 A 12/1990 Moon

(56) References Cited

U.S. PATENT DOCUMENTS

| | | | |
|---|---|---|---|
| 4,979,953 | A | 12/1990 | Spence |
| 4,989,805 | A | 2/1991 | Burke |
| 5,001,817 | A | 3/1991 | De Bortoli et al. |
| 5,016,327 | A | 5/1991 | Klausner |
| 5,042,177 | A | 8/1991 | Schoch |
| 5,062,225 | A | 11/1991 | Gorza |
| 5,065,480 | A | 11/1991 | DeBortoli |
| 5,065,481 | A | 11/1991 | Walkhoff |
| 5,108,216 | A | 4/1992 | Geyer et al. |
| 5,117,567 | A | 6/1992 | Berger |
| 5,152,038 | A | 10/1992 | Schoch |
| 5,157,813 | A | 10/1992 | Carroll |
| 5,158,428 | A | 10/1992 | Gessner et al. |
| 5,177,882 | A | 1/1993 | Berger |
| 5,181,331 | A | 1/1993 | Berger |
| 5,184,378 | A | 2/1993 | Batra |
| D333,552 | S | 3/1993 | Berger et al. |
| 5,205,055 | A | 4/1993 | Harrell |
| 5,233,767 | A | 8/1993 | Kramer |
| 5,249,377 | A | 10/1993 | Walkhoff |
| 5,259,094 | A | 11/1993 | Zepeda |
| 5,315,741 | A | 5/1994 | Debberke |
| 5,319,868 | A | 6/1994 | Hallenbeck |
| 5,319,869 | A | 6/1994 | McDonald et al. |
| 5,325,613 | A | 7/1994 | Sussmann |
| 5,327,662 | A | 7/1994 | Hallenbeck |
| 5,333,398 | A | 8/1994 | Seo |
| 5,335,401 | A | 8/1994 | Hanson |
| 5,341,583 | A | 8/1994 | Hallenbeck |
| 5,345,697 | A | 9/1994 | Quellais |
| 5,355,596 | A | 10/1994 | Sussmann |
| 5,357,654 | A | 10/1994 | Hsing-Chi |
| 5,371,957 | A | 12/1994 | Gaudio |
| 5,381,609 | A | 1/1995 | Hieblinger |
| 5,392,535 | A | 2/1995 | Van Noy et al. |
| D357,576 | S | 4/1995 | Steinweis |
| 5,425,161 | A | 6/1995 | Schoch |
| 5,425,185 | A | 6/1995 | Gansler |
| 5,430,960 | A | 7/1995 | Richardson |
| 5,433,648 | A | 7/1995 | Frydman |
| 5,454,140 | A | 10/1995 | Murai |
| 5,463,822 | A | 11/1995 | Miller |
| 5,477,593 | A | 12/1995 | Leick |
| D367,755 | S | 3/1996 | Jones |
| D367,954 | S | 3/1996 | Dion |
| 5,502,902 | A | 4/1996 | Sussmann |
| 5,511,325 | A | 4/1996 | Hieblinger |
| 5,526,585 | A | 6/1996 | Brown et al. |
| 5,535,531 | A | 7/1996 | Karabed et al. |
| 5,537,763 | A | 7/1996 | Donnadieu et al. |
| 5,557,864 | A | 9/1996 | Marks |
| 5,566,474 | A | 10/1996 | Leick et al. |
| D375,831 | S | 11/1996 | Perry |
| 5,596,820 | A | 1/1997 | Edauw et al. |
| 5,599,000 | A | 2/1997 | Bennett |
| 5,599,288 | A | 2/1997 | Shirley et al. |
| 5,600,874 | A | 2/1997 | Jungkind |
| 5,606,778 | A | 3/1997 | Jungkind |
| 5,607,448 | A | 3/1997 | Stahl et al. |
| D379,113 | S | 5/1997 | McDonald et al. |
| D379,626 | S | 6/1997 | Mak |
| 5,638,588 | A | 6/1997 | Jungkind |
| 5,640,785 | A | 6/1997 | Egelja |
| 5,647,104 | A | 7/1997 | James |
| 5,651,198 | A | 7/1997 | Sussmann |
| 5,669,116 | A | 9/1997 | Jungkind |
| 5,692,319 | A | 12/1997 | Parker et al. |
| 5,718,021 | A | 2/1998 | Tatum |
| 5,718,065 | A | 2/1998 | Locker |
| 5,720,084 | A | 2/1998 | Chen |
| 5,732,483 | A | 3/1998 | Cagliari |
| 5,732,648 | A | 3/1998 | Aragon |
| 5,736,696 | A | 4/1998 | Del Rosso |
| 5,737,854 | A | 4/1998 | Sussmann |
| 5,755,044 | A | 5/1998 | Veylupek |
| 5,756,298 | A | 5/1998 | Burczak |
| 5,761,777 | A | 6/1998 | Leick |
| 5,772,146 | A | 6/1998 | Kawamoto et al. |
| 5,784,809 | A | 7/1998 | McDonald |
| 5,791,068 | A | 8/1998 | Bernier et al. |
| 5,819,378 | A | 10/1998 | Doyle |
| 5,833,640 | A | 11/1998 | Vazquez, Jr. et al. |
| 5,839,210 | A | 11/1998 | Bernier et al. |
| 5,845,371 | A | 12/1998 | Chen |
| 5,906,057 | A | 5/1999 | Borsoi |
| 5,909,946 | A | 6/1999 | Okajima |
| D413,197 | S | 8/1999 | Faye |
| 5,934,599 | A | 8/1999 | Hammerslag |
| 5,937,542 | A | 8/1999 | Bourdeau |
| 5,956,823 | A | 9/1999 | Borel |
| 5,971,946 | A | 10/1999 | Quinn et al. |
| 6,015,110 | A | 1/2000 | Lai |
| 6,032,387 | A | 3/2000 | Johnson |
| 6,038,791 | A | 3/2000 | Cornelius et al. |
| 6,052,921 | A | 4/2000 | Oreck |
| 6,070,886 | A | 6/2000 | Cornelius et al. |
| 6,070,887 | A | 6/2000 | Cornelius et al. |
| 6,083,857 | A | 7/2000 | Bottger |
| 6,088,936 | A | 7/2000 | Bahl |
| 6,102,412 | A | 8/2000 | Staffaroni |
| D430,724 | S | 9/2000 | Matis et al. |
| 6,119,318 | A | 9/2000 | Maurer |
| 6,119,372 | A | 9/2000 | Okajima |
| 6,128,835 | A | 10/2000 | Ritter et al. |
| 6,128,836 | A | 10/2000 | Barret |
| 6,148,489 | A | 11/2000 | Dickie et al. |
| D438,452 | S | 3/2001 | Tsai |
| 6,202,953 | B1 | 3/2001 | Hammerslag |
| 6,219,891 | B1 | 4/2001 | Maurer et al. |
| 6,240,657 | B1 | 6/2001 | Weber et al. |
| 6,256,798 | B1 | 7/2001 | Egolf et al. |
| 6,267,390 | B1 | 7/2001 | Maravetz et al. |
| 6,286,233 | B1 | 9/2001 | Gaither |
| 6,289,558 | B1 | 9/2001 | Hammerslag |
| 6,311,633 | B1 | 11/2001 | Keire |
| D456,130 | S | 4/2002 | Towns |
| 6,370,743 | B2 | 4/2002 | Choe |
| 6,401,364 | B1 | 6/2002 | Burt |
| 6,416,074 | B1 | 7/2002 | Maravetz et al. |
| 6,467,195 | B2 | 10/2002 | Pierre et al. |
| 6,477,793 | B1 | 11/2002 | Pruitt et al. |
| 6,502,286 | B1 | 1/2003 | Dubberke |
| 6,543,159 | B1 | 4/2003 | Carpenter et al. |
| 6,568,103 | B2 | 5/2003 | Durocher |
| D477,364 | S | 7/2003 | Tsai |
| 6,606,804 | B2 | 8/2003 | Kaneko et al. |
| 6,694,643 | B1 | 2/2004 | Hsu |
| 6,708,376 | B1 | 3/2004 | Landry |
| 6,711,787 | B2 | 3/2004 | Jungkind et al. |
| 6,735,829 | B2 | 5/2004 | Hsu |
| 6,757,991 | B2 | 7/2004 | Sussmann |
| 6,775,928 | B2 | 8/2004 | Grande et al. |
| 6,792,702 | B2 | 9/2004 | Borsoi et al. |
| D497,183 | S | 10/2004 | Chiu |
| 6,802,439 | B2 | 10/2004 | Azam et al. |
| 6,823,610 | B1 | 11/2004 | Ashley |
| 6,871,812 | B1 | 3/2005 | Chang |
| 6,877,256 | B2 | 4/2005 | Martin et al. |
| 6,880,271 | B2 | 4/2005 | Caeran |
| 6,899,720 | B1 | 5/2005 | McMillan |
| 6,922,917 | B2 | 8/2005 | Kerns et al. |
| 6,938,913 | B2 | 9/2005 | Elkington |
| 6,945,543 | B2 | 9/2005 | De Bortoli et al. |
| D510,183 | S | 10/2005 | Tresser |
| 6,976,972 | B2 | 12/2005 | Bradshaw |
| 6,993,859 | B2 | 2/2006 | Martin et al. |
| D521,226 | S | 5/2006 | Douglas et al. |
| 7,073,279 | B2 | 7/2006 | Min |
| 7,076,843 | B2 | 7/2006 | Sakabayashi |
| 7,082,701 | B2 | 8/2006 | Dalgaard et al. |
| 7,096,559 | B2 | 8/2006 | Johnson et al. |
| 7,134,224 | B2 | 11/2006 | Elkington et al. |
| 7,266,911 | B2 | 9/2007 | Holzer et al. |
| 7,281,341 | B2 | 10/2007 | Reagan et al. |

(56) References Cited

U.S. PATENT DOCUMENTS 7,293,373 B2 11/2007 Reagan et al.
7,331,126 B2 2/2008 Johnson
7,343,701 B2 3/2008 Pare et al.
7,360,282 B2 4/2008 Borsoi
7,367,522 B2 5/2008 Chen
7,386,947 B2 6/2008 Martin et al.
7,392,602 B2 7/2008 Reagan et al.
7,401,423 B2 7/2008 Reagan et al.
D587,105 S 2/2009 Chang
7,490,458 B2 2/2009 Ford
7,516,914 B2 4/2009 Kovacevich et al.
7,568,298 B2 8/2009 Kerns
7,582,102 B2 9/2009 Heinz et al.
7,584,528 B2 9/2009 Hu
7,591,050 B2 9/2009 Hammerslag
7,597,675 B2 10/2009 Ingimundarson et al.
7,600,660 B2 10/2009 Kasper et al.
7,617,573 B2 11/2009 Chen
7,624,517 B2 12/2009 Smith
7,648,404 B1 1/2010 Martin
7,650,705 B2 1/2010 Donnadieu et al.
7,694,354 B2 4/2010 Philpott et al.
7,752,774 B2 7/2010 Ussher
7,757,412 B2 7/2010 Farys
7,774,956 B2 8/2010 Dua et al.
D626,322 S 11/2010 Servettaz
7,841,106 B2 11/2010 Farys
7,871,334 B2 1/2011 Young et al.
7,877,845 B2 2/2011 Signori
D633,375 S 3/2011 Jablonka
7,900,378 B1 3/2011 Busse
7,908,769 B2 3/2011 Pellegrini
7,947,061 B1 5/2011 Reis
7,950,112 B2 5/2011 Hammerslag et al.
7,954,204 B2 6/2011 Hammerslag et al.
7,963,049 B2 6/2011 Messmer
7,992,261 B2 8/2011 Hammerslag et al.
D646,790 S 10/2011 Castillo et al.
8,056,150 B2 11/2011 Stokes et al.
8,056,265 B2 11/2011 Pirkle
8,061,061 B1 11/2011 Rivas
8,074,379 B2 12/2011 Robinson, Jr. et al.
8,091,182 B2 1/2012 Hammerslag et al.
8,109,015 B2 2/2012 Signori
D663,850 S 7/2012 Joseph
D663,851 S 7/2012 Joseph
8,215,033 B2 7/2012 Carboy et al.
8,231,074 B2 7/2012 Hu et al.
D665,088 S 8/2012 Joseph
8,235,321 B2 8/2012 Chen
8,245,371 B2 8/2012 Chen
8,257,293 B2 9/2012 Ingimundarson et al.
8,266,827 B2 9/2012 Dojan et al.
8,277,401 B2 10/2012 Hammerslag et al.
8,302,329 B2 11/2012 Hurd et al.
8,303,527 B2 11/2012 Joseph
8,308,098 B2 11/2012 Chen
8,321,999 B2 12/2012 Boden
D673,443 S 1/2013 Elrod
8,353,087 B2 1/2013 Chen
8,353,088 B2 1/2013 Ha
8,381,362 B2 2/2013 Hammerslag
D677,045 S 3/2013 Voskuil
D679,019 S 3/2013 Siddle et al.
D679,175 S 4/2013 Moreau et al.
8,424,168 B2 4/2013 Soderberg et al.
8,434,200 B2 5/2013 Chen
8,468,657 B2 6/2013 Soderberg
8,490,299 B2 7/2013 Dua et al.
8,516,662 B2 8/2013 Goodman et al.
D691,027 S 10/2013 Rainer
8,578,632 B2 11/2013 Bell et al.
8,652,164 B1 2/2014 Aston
D702,529 S 4/2014 Diez Herrera
8,713,820 B2 5/2014 Kerns et al.
D712,727 S 9/2014 Geiger
8,984,719 B2 3/2015 Soderberg et al.
9,072,341 B2 7/2015 Jungkind
D735,987 S 8/2015 Hsu
9,101,181 B2 8/2015 Soderberg et al.
9,125,455 B2 9/2015 Kerns et al.
9,138,030 B2 9/2015 Soderberg et al.
9,179,729 B2 * 11/2015 Cotterman ..... A42B 3/324
9,248,040 B2 2/2016 Soderberg et al.
9,259,056 B2 2/2016 Soderberg et al.
9,339,082 B2 5/2016 Hammerslag et al.
9,375,053 B2 6/2016 Burns et al.
9,408,437 B2 8/2016 Goodman et al.
D767,269 S 9/2016 Lovett et al.
9,516,923 B2 12/2016 Capra et al.
D776,421 S 1/2017 Venturini
9,532,626 B2 1/2017 Lovett et al.
9,610,185 B2 4/2017 Capra et al.
9,629,417 B2 4/2017 Cavanagh et al.
9,681,705 B2 6/2017 Trudel et al.
9,700,101 B2 7/2017 Lovett et al.
9,706,814 B2 7/2017 Converse et al.
9,770,070 B2 9/2017 Cotterman et al.
9,867,430 B2 1/2018 Hammerslag et al.
9,872,790 B2 1/2018 Capra et al.
2002/0002781 A1 1/2002 Bouvier
2002/0007570 A1 1/2002 Girard
2002/0050076 A1 5/2002 Borsoi et al.
2002/0062579 A1 5/2002 Caeran
2002/0095750 A1 7/2002 Hammerslag
2002/0129518 A1 9/2002 Borsoi et al.
2002/0148142 A1 10/2002 Oorei et al.
2002/0166260 A1 11/2002 Borsoi
2002/0178548 A1 12/2002 Freed
2003/0041478 A1 3/2003 Liu
2003/0051374 A1 3/2003 Freed
2003/0079376 A1 5/2003 Oorei et al.
2003/0144620 A1 7/2003 Sieller
2003/0150135 A1 8/2003 Liu
2003/0177662 A1 9/2003 Elkington et al.
2003/0204938 A1 11/2003 Hammerslag
2004/0041452 A1 3/2004 Williams
2004/0159017 A1 8/2004 Martin
2004/0211039 A1 10/2004 Livingston
2004/0221433 A1 11/2004 Wolfberg
2005/0054962 A1 3/2005 Bradshaw
2005/0060912 A1 3/2005 Holzer et al.
2005/0081339 A1 4/2005 Sakabayashi
2005/0081403 A1 4/2005 Mathieu
2005/0087115 A1 4/2005 Martin
2005/0098673 A1 5/2005 Huang
2005/0102861 A1 5/2005 Martin
2005/0126043 A1 6/2005 Reagan et al.
2005/0172463 A1 8/2005 Rolla
2005/0178872 A1 8/2005 Hyun
2005/0184186 A1 8/2005 Tsoi et al.
2005/0198866 A1 9/2005 Wiper et al.
2005/0247813 A1 11/2005 Kovacevich et al.
2006/0135901 A1 6/2006 Ingimundarson et al.
2006/0156517 A1 7/2006 Hammerslag et al.
2006/0174516 A1 8/2006 Peruzzo
2006/0179685 A1 8/2006 Borel et al.
2006/0185193 A1 8/2006 Pellegrini
2006/0196083 A1 9/2006 Martin
2006/0213085 A1 9/2006 Azam
2006/0287627 A1 12/2006 Johnson
2007/0006489 A1 1/2007 Case, Jr. et al.
2007/0063459 A1 3/2007 Kavarsky
2007/0068040 A1 3/2007 Farys
2007/0084956 A1 4/2007 Chen
2007/0113524 A1 5/2007 Lander
2007/0128959 A1 6/2007 Cooke
2007/0169378 A1 7/2007 Sodeberg et al.
2007/0271824 A1 11/2007 Holzer et al.
2008/0016717 A1 1/2008 Ruban
2008/0060167 A1 3/2008 Hammerslag et al.
2008/0060168 A1 3/2008 Hammerslag et al.
2008/0066272 A1 3/2008 Hammerslag et al.
2008/0066345 A1 3/2008 Hammerslag et al.

(56) References Cited

U.S. PATENT DOCUMENTS

| | | | |
|---|---|---|---|
| 2008/0066346 | A1 | 3/2008 | Hammerslag et al. |
| 2008/0068204 | A1 | 3/2008 | Carmen et al. |
| 2008/0083135 | A1 | 4/2008 | Hammerslag et al. |
| 2008/0092279 | A1 | 4/2008 | Chiang |
| 2008/0172848 | A1 | 7/2008 | Chen |
| 2008/0196224 | A1 | 8/2008 | Hu |
| 2009/0019734 | A1 | 1/2009 | Reagan et al. |
| 2009/0071041 | A1 | 3/2009 | Hooper |
| 2009/0090029 | A1 | 4/2009 | Kishino |
| 2009/0172928 | A1 | 7/2009 | Messmer et al. |
| 2009/0184189 | A1 | 7/2009 | Soderberg et al. |
| 2009/0272007 | A1 | 11/2009 | Beers et al. |
| 2009/0277043 | A1 | 11/2009 | Graser et al. |
| 2010/0064547 | A1 | 3/2010 | Kaplan |
| 2010/0101061 | A1 | 4/2010 | Ha |
| 2010/0115744 | A1 | 5/2010 | Fong |
| 2010/0139057 | A1 | 6/2010 | Soderberg et al. |
| 2010/0154254 | A1 | 6/2010 | Fletcher |
| 2010/0175163 | A1 | 7/2010 | Litke |
| 2010/0251524 | A1 | 10/2010 | Chen |
| 2010/0269373 | A1 | 10/2010 | Pirkle |
| 2010/0299959 | A1 | 12/2010 | Hammerslag |
| 2010/0319216 | A1 | 12/2010 | Grenzke et al. |
| 2011/0000173 | A1 | 1/2011 | Lander |
| 2011/0071647 | A1 | 3/2011 | Mahon |
| 2011/0099843 | A1 | 5/2011 | Jung |
| 2011/0162236 | A1 | 7/2011 | Voskuil et al. |
| 2011/0167543 | A1 | 7/2011 | Kovacevich et al. |
| 2011/0191992 | A1 | 8/2011 | Chen |
| 2011/0197362 | A1 | 8/2011 | Chella et al. |
| 2011/0225843 | A1 | 9/2011 | Kerns et al. |
| 2011/0258876 | A1 | 10/2011 | Baker et al. |
| 2011/0266384 | A1 | 11/2011 | Goodman et al. |
| 2012/0000091 | A1 | 1/2012 | Cotterman et al. |
| 2012/0004587 | A1 | 1/2012 | Nickel et al. |
| 2012/0005865 | A1 | 1/2012 | Boden |
| 2012/0005995 | A1 | 1/2012 | Emery |
| 2012/0023717 | A1 | 2/2012 | Chen |
| 2012/0047620 | A1 | 3/2012 | Ellis et al. |
| 2012/0101417 | A1 | 4/2012 | Joseph |
| 2012/0102783 | A1 | 5/2012 | Swigart et al. |
| 2012/0138882 | A1 | 6/2012 | Moore et al. |
| 2012/0157902 | A1 | 6/2012 | Castillo et al. |
| 2012/0167290 | A1 | 7/2012 | Kovacevich et al. |
| 2012/0174437 | A1 | 7/2012 | Heard |
| 2012/0204381 | A1 | 8/2012 | Ingimundarson et al. |
| 2012/0228419 | A1 | 9/2012 | Chen |
| 2012/0246974 | A1 | 10/2012 | Hammerslag et al. |
| 2012/0310273 | A1 | 12/2012 | Thorpe |
| 2013/0012856 | A1 | 1/2013 | Hammerslag et al. |
| 2013/0014359 | A1 | 1/2013 | Chen |
| 2013/0019501 | A1 | 1/2013 | Gerber |
| 2013/0025100 | A1 | 1/2013 | Ha |
| 2013/0091667 | A1 | 4/2013 | Zerfas et al. |
| 2013/0091674 | A1 | 4/2013 | Chen |
| 2013/0092780 | A1 | 4/2013 | Soderberg et al. |
| 2013/0239303 | A1 | 9/2013 | Cotterman et al. |
| 2013/0269219 | A1 | 10/2013 | Burns et al. |
| 2013/0277485 | A1 | 10/2013 | Soderberg et al. |
| 2013/0312293 | A1 | 11/2013 | Gerber |
| 2013/0340283 | A1 | 12/2013 | Bell et al. |
| 2013/0345612 | A1 | 12/2013 | Bannister et al. |
| 2014/0068838 | A1 | 3/2014 | Beers et al. |
| 2014/0082963 | A1 | 3/2014 | Beers |
| 2014/0094728 | A1 | 4/2014 | Soderberg et al. |
| 2014/0117140 | A1 | 5/2014 | Goodman et al. |
| 2014/0123440 | A1 | 5/2014 | Capra et al. |
| 2014/0123449 | A1 | 5/2014 | Soderberg et al. |
| 2014/0208550 | A1 | 7/2014 | Neiley |
| 2014/0221889 | A1 | 8/2014 | Burns et al. |
| 2014/0257156 | A1 | 9/2014 | Capra et al. |
| 2014/0290016 | A1 | 10/2014 | Lovett et al. |
| 2014/0359981 | A1 | 12/2014 | Cotterman et al. |
| 2015/0005685 | A1 | 1/2015 | Chetlapalli et al. |
| 2015/0007422 | A1 | 1/2015 | Cavanagh et al. |
| 2015/0014463 | A1 | 1/2015 | Converse et al. |
| 2015/0026936 | A1 | 1/2015 | Kerns et al. |
| 2015/0033519 | A1 | 2/2015 | Hammerslag et al. |
| 2015/0059206 | A1 | 3/2015 | Lovett et al. |
| 2015/0076272 | A1 | 3/2015 | Trudel et al. |
| 2015/0089779 | A1 | 4/2015 | Lawrence et al. |
| 2015/0089835 | A1 | 4/2015 | Hammerslag et al. |
| 2015/0101160 | A1 | 4/2015 | Soderberg et al. |
| 2015/0150705 | A1 | 6/2015 | Capra et al. |
| 2015/0151070 | A1 | 6/2015 | Capra et al. |
| 2015/0190262 | A1 | 7/2015 | Capra et al. |
| 2015/0223608 | A1 | 8/2015 | Capra et al. |
| 2015/0237962 | A1 | 8/2015 | Soderberg et al. |
| 2015/0313319 | A1 | 11/2015 | Ha |
| 2015/0335458 | A1 | 11/2015 | Romo |
| 2016/0058127 | A1 | 3/2016 | Burns et al. |
| 2016/0058130 | A1 | 3/2016 | Boney |
| 2016/0157561 | A1 | 6/2016 | Schum et al. |
| 2017/0273390 | A1* | 9/2017 | Maloney ..... A42B 3/145 |
| 2017/0347736 | A1* | 12/2017 | Penner ..... A42B 3/085 |
| 2018/0092424 | A1* | 4/2018 | Hall ..... A42B 3/142 |

FOREIGN PATENT DOCUMENTS

| | | | |
|---|---|---|---|
| CH | 199766 | | 9/1938 |
| CH | 204 834 | A | 5/1939 |
| CN | 2613167 | | 4/2004 |
| CN | 201015448 | | 2/2008 |
| DE | 641976 | | 2/1937 |
| DE | 23 41 658 | | 3/1974 |
| DE | 29 00 077 | A1 | 7/1980 |
| DE | 31 01 952 | A1 | 9/1982 |
| DE | 38 13 470 | | 11/1989 |
| DE | 3822113 | C2 | 1/1990 |
| DE | 43 02 401 | A1 | 8/1994 |
| DE | 43 05 671 | A1 | 9/1994 |
| DE | 9308037 | | 10/1994 |
| DE | 43 26 049 | A1 | 2/1995 |
| DE | 9315776 | | 2/1995 |
| DE | 29503552.8 | | 4/1995 |
| DE | 196 24 553 | | 1/1998 |
| DE | 197 00 309 | | 7/1998 |
| DE | 19945045 | A1 | 3/2001 |
| DE | 11 2006 000 124 | T5 | 1/2008 |
| DE | 20 2010 000 354 | U1 | 6/2010 |
| DE | 11 2013 005 273 | T5 | 9/2015 |
| DE | 11 2014 003 135 | T5 | 4/2016 |
| EP | 0 056 953 | | 8/1982 |
| EP | 0 079 874 | | 5/1983 |
| EP | 0 099 504 | | 2/1984 |
| EP | 0 123 050 | | 10/1984 |
| EP | 0 155 596 | | 9/1985 |
| EP | 0 201 051 | | 11/1986 |
| EP | 0 255 869 | | 2/1988 |
| EP | 0 297 342 | | 1/1989 |
| EP | 0 393 380 | | 10/1990 |
| EP | 0 474 708 | | 3/1992 |
| EP | 0 589 232 | A1 | 3/1994 |
| EP | 0 589 233 | A1 | 3/1994 |
| EP | 0 614 625 | A1 | 9/1994 |
| EP | 0 651 954 | A1 | 5/1995 |
| EP | 0 679 346 | | 11/1995 |
| EP | 0 693 260 | B1 | 1/1996 |
| EP | 0 734 662 | A1 | 10/1996 |
| EP | 0 848 917 | | 6/1998 |
| EP | 0 923 965 | | 6/1999 |
| EP | 0 937 467 | | 8/1999 |
| EP | 1163860 | | 12/2001 |
| EP | 1 219 195 | | 7/2002 |
| EP | 1 236 412 | A | 9/2002 |
| EP | 2 052 636 | | 4/2009 |
| EP | 2298107 | B1 | 3/2011 |
| EP | 2359708 | | 8/2011 |
| EP | 2981184 | | 2/2016 |
| EP | 3003087 | | 4/2016 |
| EP | 3019043 | | 5/2016 |
| EP | 3044477 | | 7/2016 |
| EP | 3071159 | | 9/2016 |
| FR | 1 404 799 | | 7/1965 |

(56) References Cited

FOREIGN PATENT DOCUMENTS

| | | | |
|---|---|---|---|
| FR | 2 019 991 | A | 7/1970 |
| FR | 2 399 811 | | 9/1979 |
| FR | 2 565 795 | | 6/1984 |
| FR | 2 598 292 | A1 | 11/1987 |
| FR | 2 726 440 | A1 | 5/1996 |
| FR | 2 770 379 | A1 | 5/1999 |
| FR | 2 814 919 | A1 | 4/2002 |
| GB | 189911673 | | 7/1899 |
| GB | 216400 | | 8/1923 |
| GB | 2 449 722 | A | 12/2008 |
| IT | 1220811 | B | 6/1990 |
| IT | 2003 A 000197 | | 4/2003 |
| IT | 2003 A 000198 | | 4/2003 |
| JP | 51-121375 | | 10/1976 |
| JP | 53-124987 | | 3/1977 |
| JP | 54-108125 | | 2/1978 |
| JP | H02-236025 | | 9/1990 |
| JP | 6-284906 | | 2/1996 |
| JP | 3030988 | | 11/1996 |
| JP | 3031760 | | 12/1996 |
| JP | 10-199366 | | 7/1998 |
| JP | 2004-016732 | | 1/2004 |
| JP | 2004-041666 | | 2/2004 |
| JP | 2009-504210 | | 2/2009 |
| KR | 20-0367882 | | 11/2004 |
| KR | 20-0400568 | | 8/2005 |
| KR | 10-0598627 | | 7/2006 |
| KR | 10-0953398 | | 4/2010 |
| KR | 10-2010-0111031 | | 10/2010 |
| KR | 10-1025134 | B1 | 3/2011 |
| KR | 10-1028468 | | 4/2011 |
| KR | 10-1053551 | | 7/2011 |
| WO | 94/27456 | | 12/1994 |
| WO | 1995/03720 | | 2/1995 |
| WO | 95/11602 | | 5/1995 |
| WO | 98/33408 | | 8/1998 |
| WO | 98/37782 | | 9/1998 |
| WO | 99/09850 | | 3/1999 |
| WO | 099/15043 | | 4/1999 |
| WO | 99/43231 | | 9/1999 |
| WO | 00/53045 | | 9/2000 |
| WO | 2000/76337 | A1 | 12/2000 |
| WO | 01/08525 | | 2/2001 |
| WO | 01/15559 | | 3/2001 |
| WO | 02/051511 | | 7/2002 |
| WO | 2004/093569 | | 11/2004 |
| WO | 2005/013748 | A1 | 2/2005 |
| WO | 2007/016983 | | 2/2007 |
| WO | 2008/015214 | | 2/2008 |
| WO | 2008/033963 | | 3/2008 |
| WO | 2009/134858 | | 11/2009 |
| WO | 2009/134864 | | 11/2009 |
| WO | 2010/059989 | A2 | 5/2010 |
| WO | 2012/165803 | A2 | 12/2012 |
| WO | 2013/025704 | A1 | 2/2013 |
| WO | 2014/036371 | A1 | 3/2014 |
| WO | 2015/035885 | | 3/2015 |
| WO | 2015/179332 | A1 | 11/2015 |
| WO | 2015/181928 | A1 | 12/2015 |

OTHER PUBLICATIONS

Anonymous, "Shore durometer," Wikipedia, the free encyclopedia, Mar. 10, 2012, XP002747470, Retrieved from the Internet: URL: https://en.wikipedia.org/w/index.php?title=Shore_durometer&oldid=481128180 [retrieved on Oct. 20, 2015] * shore A, shore D, durometer, polymer, rubber, gel; the whole document *, 6 pages.

Asolo® Boot Brochure Catalog upon information and belief date is as early as Aug. 22, 1997, 12 pages.

La Sportiva, A Technical Lightweight Double Boot for Cold Environments, 1 page. Accessed on May 27, 2015. Retrieved from http://www.sportiva.com/products/footwear/mountain/spantik.

"Strength of materials used to make my Safety Harnesses," Elaine, Inc. Jul. 9, 2012. Retrieved from <https://web.archive.org/web/20120709002720/http://www.childharness.ca/strength_data.html> on Mar. 17, 2014, 2 pages.

"Save Tourniquet," 3 pages. Copyright 2015. Accessed on Dec. 11, 2015. Retrieved from http://www.savetourniquet.com/.

Certificate of Design Registration No. 30-809409 on Aug. 3, 2015 from the Korean Intellectual Property Office for Appln No. 30-2015-11475, 2 pages.

Certificate of Design Registration No. 30-809410 on Aug. 3, 2015 from the Korean Intellectual Property Office for Appln No. 30-2015-11476, 2 pages.

European Search Report for EP 14168875 dated Oct. 29, 2014, 9 pages.

European Search Report for EP 14760642 dated Aug. 5, 2016, all pages.

Extended European Search Report for EP 14743075 dated Oct. 10, 2016, all pages.

International Search Report and Written Opinion for PCT/US2013/032326 dated Jun. 14, 2013, 27 pages.

International Preliminary Report on Patentability for PCT/US2013/032326 dated Sep. 16, 2014, 6 pages.

International Search Report and Written Opinion for PCT/US2013/057637 dated Apr. 7, 2014, 34 pages.

International Preliminary Report on Patentability for PCT/US2013/057637 dated Mar. 3, 2015, 9 pages.

International Search Report and Written Opinion for PCT/US2013/068342 dated Apr. 7, 2014, 29 pages.

International Preliminary Report on Patentability for PCT/US2013/068342 dated May 5, 2015, 9 pages.

International Search Report and Written Opinion for PCT/US2013/068814 dated Jun. 9, 2014, 18 pages.

International Preliminary Report on Patentability for PCT/US2013/068814 dated May 12, 2015, 12 pages.

International Search Report and Written Opinion for PCT/US2014/014952 dated Apr. 25, 2014, 17 pages.

International Preliminary Report on Patentability for PCT/US2014/014952 dated Aug. 11, 2015, 9 pages.

International Search Report and Written Opinion for PCT/US2014/020894 dated Jun. 20, 2014, 12 pages.

International Preliminary Report on Patentability for PCT/US2014/020894 dated Sept. 8, 2015, 7 pages.

International Search Report and Written Opinion for PCT/US2014/041144 dated Dec. 10, 2014, 13 pages.

International Preliminary Report on Patentability for PCT/US2014/041144 dated Dec. 8, 2015, 9 pages.

International Search Report and Written Opinion for PCT/US2014/055710 dated Jul. 6, 2015, 19 pages.

International Search Report and Written Opinion for PCT/US2014/066212 dated Apr. 22, 2015, 16 pages.

International Preliminary Report on Patentability for PCT/US2014/066212 dated May 24, 2016, all pages.

International Search Report and Written Opinion for PCT/US2014/032574 dated Oct. 31, 2014, 19 pages.

International Preliminary Report on Patentability for PCT/US2014/032574 dated Oct. 6, 2015, 12 pages.

International Search Report and Written Opinion for PCT/US2014/045291 dated Nov. 6, 2014, 12 pages.

International Preliminary Report on Patentability for PCT/US2014/045291 dated Jan. 5, 2016, 5 pages.

International Search Report and Written Opinion for PCT/US2014/046238 dated Nov. 21, 2014, 17 pages.

International Preliminary Report on Patentability for PCT/US2014/046238 dated Jan. 12, 2016, 11 pages.

International Search Report and Written Opinion for PCT/US2014/054420 dated Jul. 6, 2015, 21 pages.

International Preliminary Report on Patentability for PCT/US2014/054420 dated Mar. 8, 2016, all pages.

International Search Report and Written Opinion for PCT/US2014/013458 dated May 19, 2014, 12 pages.

International Preliminary Report on Patentability for PCT/US2014/013458 dated Jul. 28, 2015, 7 pages.

(56) References Cited

OTHER PUBLICATIONS

Notice of Reasons for Rejection from the Japanese Patent Office dated Feb. 26, 2015 for design application No. 2014-015570, 4 pages.
Notice of Reasons for Rejection from the Japanese Patent Office dated Oct. 5, 2015 for design application No. 2015-004923, 4 pages.
Office Action from the German Patent and Trademark Office for Appln No. 402015100191.2, regarding the title of the invention, 2 pages.
Office Action for DE 11 2013 005 273.3, all pages.
Office Action dated Jun. 19, 2017 for EP 14 810 068.8, 3 pages.
Receipt of Certificate of Design Registration No. 1529678 from the Japanese Patent Office for design application No. 2014-015570 dated Jun. 26, 2015, 1 page.
Supplementary European Search Report for EP 13761841 dated Oct. 21, 2015, all pages.
Office Action for EP 14760642 dated Feb. 28, 2018, all pages.
The Preliminary Rejections from the Korean Intellectual Property Office for Application No. 30-2014-34959, is not translated into English. The document requests a renaming of the application to be in accordance with Korean patent law, 5 pages total.
The Preliminary Rejections from the Korean Intellectual Property Office for Application No. 30-2014-34959, is not translated into English. The document requests a revision of the drawings to be in accordance with Korean patent law, 6 pages total.
International Search Report and Written Opinion for PCT/US2015/054530 dated Jan. 13, 2016, all pages.
Notice of Reasons for Rejection for JP 2016-518004 dated Jan. 27, 2017, all pages.
Notice of Preliminary Rejection for Korean Patent Appln No. 10-2015-7037205, all pages.
Notice of Preliminary Rejection for Korean Intellectual Property Office for KR Patent Appln. No. 10-2016-7003041 dated Aug. 9, 2017, all pages.
Notice of Reasons for Rejection from the Japanese Patent Office dated May 24, 2017 for JP Appln. No. 2016-525791, all pages.
Notice of Preliminary Rejection (Non-Final) from the Korean Intellectual Property Office for KR Appln No. 10-2016-7015883, all pages.

* cited by examiner

CLOSURE COMPONENTS FOR A HELMET LAYER AND METHODS FOR INSTALLING SAME

CROSS-REFERENCE TO RELATED APPLICATIONS

This application claims priority to Provisional U.S. Patent Application No. 62/503,866 filed May 9, 2017, entitled "Closure Components for a Helmet Layer and Methods for Installing Same," the entire disclosure of which is hereby incorporated by reference, for all purposes, as if fully set forth herein.

BACKGROUND

This invention relates generally to helmets and more specifically to helmet systems that employ reel based tensioning devices. Helmets are worn to protect a wearer's head from trauma due to impacts from surrounding objects. The impact may be due to a fall or may be due to something else, such as an external object striking the helmet. Various restraints are used to secure a helmet to a wearer's head. A common helmet restraint is a strap that is positioned under or around the wearer's chin to secure the helmet atop the head. The strap commonly includes a buckle that allows the strap to be easily unbuckled and removed from about the chin. Reel based tensioning devices may also be employed to secure the strap about the wearer's chin and/or to secure the helmet about the wearer's head.

BRIEF DESCRIPTION

The embodiments herein describe reel based closure devices that may be used with a liner or shell, which is a material protection layer that is disposed within a helmet. The liner or shell helps protect a wearer's head against head injuries by allowing the helmet to move or rotate relative to the head upon impact from an external object. According to one aspect, a protective component for use with a helmet or other headwear includes a liner or shell that is coupleable with the helmet/headwear so that the liner or shell is positioned on an interior surface of the helmet/headwear when coupled with the helmet/headwear. The liner or shell is shaped to correspond to the helmet/headwear and is made of a low-friction material. The liner or shell is also coupled with the helmet/headwear so that the liner or shell is rotatable relative to the helmet/headwear, thereby enabling a relative motion between a wearer's head and the helmet/headwear responsive to a force or an impact being exerted on the helmet/headwear. A rear support member is removably coupleable with a rear portion of the liner or shell and a tightening mechanism is attached to the rear support member. The tightening mechanism is operably coupled with a tension member and includes a rotatable spool and a knob that is configured to rotate the spool. Rotation of the spool in a tightening direction winds the tension member about the spool to tension the tension member and thereby tighten the liner or shell about the wearer's head.

The protective component typically also includes a front support member that is spaced apart from the rear support member forming a gap therebetween. The tension member is coupled to the rear support member and the front support member and extends across the gap between the rear support member and the front support member. Tensioning of the tension member pulls the front support member toward the rear support member. The protective component typically further includes at least one intermediate tender that is configured to engage the tension member and route the tension member between the front support member and the rear support member.

The intermediate tender includes at least one guide within which the tension member is slidably positioned.

The rear support member commonly is a yoke that is configured to engage the back of the wearer's head. The yoke or rear support member also commonly includes an engagement member that is configured to couple with a corresponding engagement member of the liner or shell to couple the rear support member to the rear portion of the liner or shell. The engagement member of the rear support member may include one or more bosses or protrusions and the engagement member of the liner or shell may include one or more apertures. The rear support member may be adjustable relative to the liner or shell so that a position of the rear support member about the wearer's head is adjustable by adjusting the position of the rear support member in relation to the liner or shell. The rear support member may be adjusted relative to the liner or shell by repositioning the boss or protrusion within a different one of said apertures.

The front support member may include a forehead strap that is configured to engage a forehead portion of a wearer's head. The front support member may include one or more temple guides that are positioned near the temples of a wearer's head. The tension member may form a single loop that extends across a right side of the liner or shell and across a left side of the liner or shell to provide a dynamic fit between the right side and the left side.

According to another aspect, a protective component for use with a helmet or other headwear includes a liner or shell that is coupleable with the helmet/headwear so that the liner or shell is positioned on an interior surface of the helmet/headwear when coupled with the helmet/headwear. The liner or shell is shaped to correspond to the helmet/headwear and is made of a low-friction material. The liner or shell is coupled with the helmet/headwear so that the liner or shell is moveable relative to the helmet/headwear responsive to a force or an impact being exerted on the helmet/headwear. The liner or shell includes a front support member, a rear support member that is spaced apart from the front support member forming a gap therebetween, and at least one intermediate tender that is positioned in the gap between the front support member and the rear support member. A tension member is coupled to the front support member and to the rear support member and extends across the gap between the front support member and the rear support member. A tightening mechanism is configured to adjust a tension of the tension member. The tightening mechanism includes a rotatable spool and a knob that is configured to rotate the spool. Rotation of the spool in a tightening direction winds the tension member about the spool to tension the tension member. The at least one intermediate tender is configured to engage the tension member between the front support member and the rear support member. The at least one intermediate tender includes at least one lace guide within which the tension member slides as the tension of the tension member is adjusted.

The at least one intermediate tender may also include an attachment portion that is configured to couple the at least one intermediate tender to the liner or shell. In other embodiments, the at least one intermediate tender is integrally formed with the liner or shell. The at least one intermediate tender is typically configured so that tensioning the tension member causes the at least one intermediate tender to move inwardly to apply a tightening force to a wearer's head. The at least one intermediate tender may additionally include a first tension member path and a second tension member path that is separated from the first tension member path.

The front support member typically includes a lace guide that is positioned on a distal end of an elongate finger that is configured to wrap circumferentially around the wearer's head. The rear support member may be removably coupleable with the liner or shell. In such embodiments, the rear support member may be a yoke that is configured to engage the back of the wearer's head. The yoke may include an engagement member that is configured to couple with a corresponding engagement member of the liner or shell to couple the yoke to the liner or shell. The engagement member of the yoke may include one or more bosses or protrusions and the engagement member of the liner or shell may include one or more apertures. The yoke may be adjustable relative to the liner or shell so that a position of the yoke about the wearer's head may be adjusted adjusting the position of the yoke relative to the liner or shell. The liner or shell may include a plurality of apertures within which the boss(es) or protrusion(s) of the yoke are positionable and the yoke may be adjusted relative to the liner or shell by repositioning the boss(es) or protrusion(s) within a different one of said plurality of apertures.

BRIEF DESCRIPTION OF THE DRAWINGS

The present invention is described in conjunction with the appended figures.

Figure 1A:
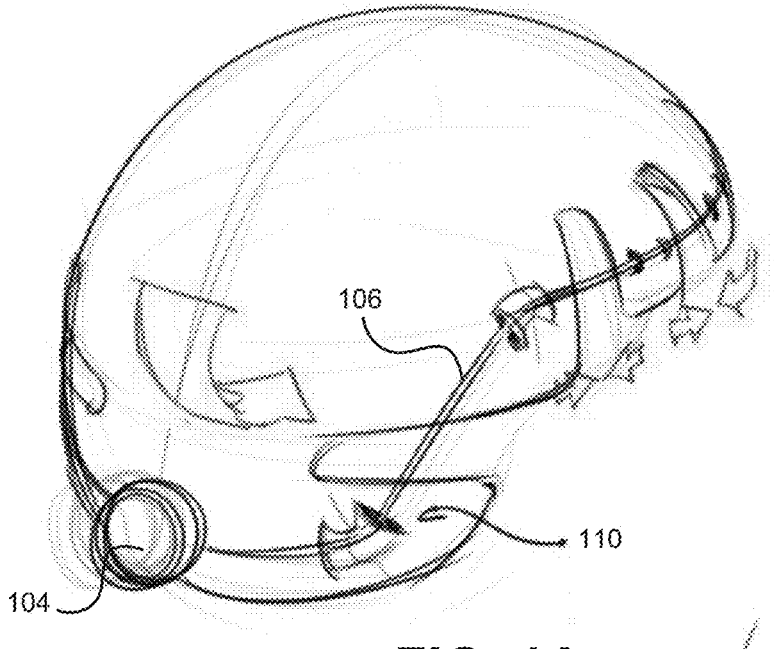
FIGS. 1A-D illustrate a helmet protective layer that is configured to fit about a wearer's head.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE DRAWINGS

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

The embodiments herein describe reel based closure devices that may be used with a liner or shell, which is a material protection layer that is disposed within a helmet (hereinafter helmet protective layer). The reel based closure devices may be used to tighten and secure the helmet protective layer about a user's head. The helmet protective layer functions by providing a low-friction layer that is integrated into the helmet. The low-friction layer reduces the transfer of a rotational motion or force from the helmet to the user's head in response to an impact of the helmet. Stated differently, the helmet protective layer enables relative motion between the user's head and the helmet regardless of the angle of impact. The relative motion between the user's head and the helmet results in some of the energy of impact being redirected and/or absorbed by the helmet and/or helmet protective layer rather than being imparted to the user's head. This energy redirection and/or energy absorption reduces the force and trauma that the user's head experiences in response to the helmet being impacted.

The helmet protective layer may be a thin, low-friction liner material that is coupled to, or otherwise positioned on, the inside of the helmet between the inner surface of the helmet and the user's head. The helmet protective layer may be coupled with the helmet via various coupling components that are flexible and/or moveable in relation to the helmet. The relative motion of the coupling components enables the energy to be redirected and/or absorbed.

The reel based closure device may be coupled with the helmet protective layer so that the reel based closure device may be operated to tighten and secure the helmet protective layer about the wearer's head. The use of the reel based closure device may enable the helmet protective layer to be worn in a comfortable yet secure manner. The reel based closure device may also enable the wearer to quickly adjust the tension in the helmet protective layer to adjust the fit of the helmet protective layer about the wearer's head for comfort and/or a desired performance.

The reel based closure device (hereinafter reel based device or reel system) is configured to tension a lace or tension member that is guided about the helmet protective layer via one or more guide members, which may be rigid components that are made of plastics or other materials, or which may be flexible and soft components that are made of fabric materials. The reel based device typically includes a knob or dial that may be grasped and rotated by a user. The knob or dial is commonly coupled with a spool about which the tension member or lace is wound in response to rotation of the knob or dial in a tightening direction. Winding of the tension member or lace about the spool tensions the tension member or lace, which in turn tightens the helmet protective layer about the wearer's head. Exemplary reel based devices are further described in U.S. patent application Ser. No. 14/297,047 filed Jun. 5, 2017, and entitled "Integrated Closure Device Components and Methods", and in U.S. Pat. No. 9,259,056, filed Jun. 21, 2013, and entitled "Reel Based Lacing System", the entire disclosures of which are incorporated by reference herein.

Figure 1D:
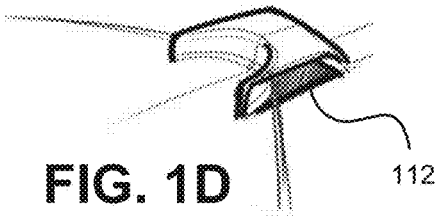
Figure 1C:
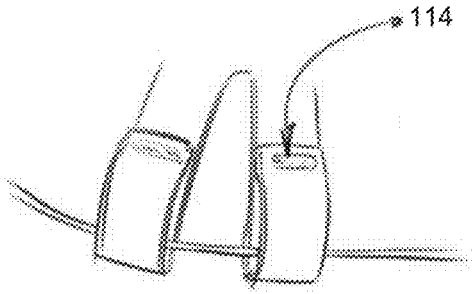
Figure 1B:
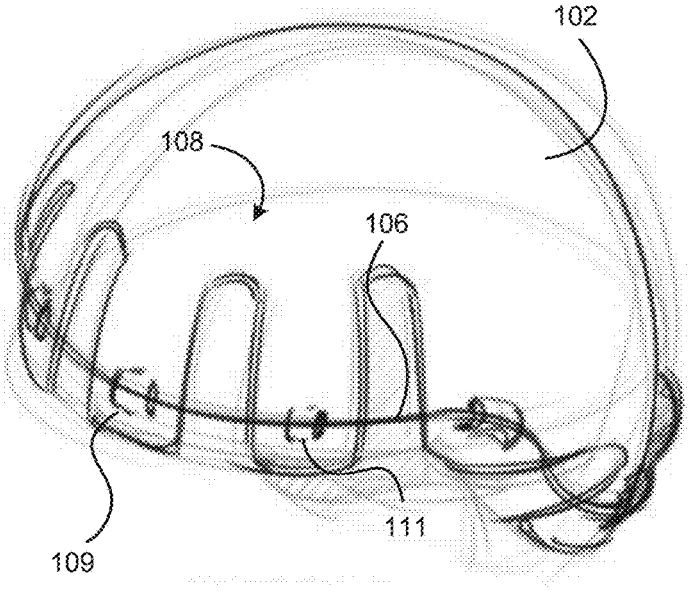

Referring now to FIGS. 1A-D, illustrated is a helmet protective layer 102 that is configured to fit about a wearer's head. A reel based device 104 is coupled with a rear portion of the helmet protective layer 102. The reel based device 104 is coupled with a tension member 106 that is guided about the helmet protective layer 102 via guide member 111. Tensioning of the tension member 106 via the reel based device 104 causes the helmet protective layer 102 to constrict about the wearer's head. The helmet protective layer 102 is configured to allow the helmet protective layer to constrict about the wearer's head. For example, the helmet protective layer may include recessed portions 108 that define or form fingers 109. The fingers 109 may move radially inward against the user's head in response to tensioning of the tension member 106. The guide members 111 may be disposed on the distal ends of the fingers 109 as illustrated in FIG. 1B.

The helmet protective layer 102 also includes a rearward member 110 that is configured to move inward against the back of the user's head as the tension member 106 is tensioned. The reel based device 104 is positioned on the rearward member 110 so that it is accessible to the wearer's hand. For example, the reel based device 104 may extend below the rear surface of the helmet (not shown) so that the reel based device 104 is accessible when the wearer dons the helmet. The rearward member 110 may include a guide member that directs or routes the lace 106 upward toward the fingers.

FIGS. 1C-D illustrate embodiments of guide members that may be employed to guide or direct the lace 106 about the helmet protective layer 102. In one embodiment, the guide member may be a component that is formed or molded onto the helmet protective layer 102, such as the formed guide member 112 illustrated in FIG. 1D. In other embodiments, the guide member may be formed or defined in a distal end of the fingers 109. For example, the distal end of the fingers 109 may be folded backward to form a loop 114 within which the lace 106 is disposed as illustrated in FIG. 1C. The backward folded distal end of the fingers 109 may be coupled together via a heat weld, adhesive bond, RF or sonic weld, and the like.

Figure 2A:
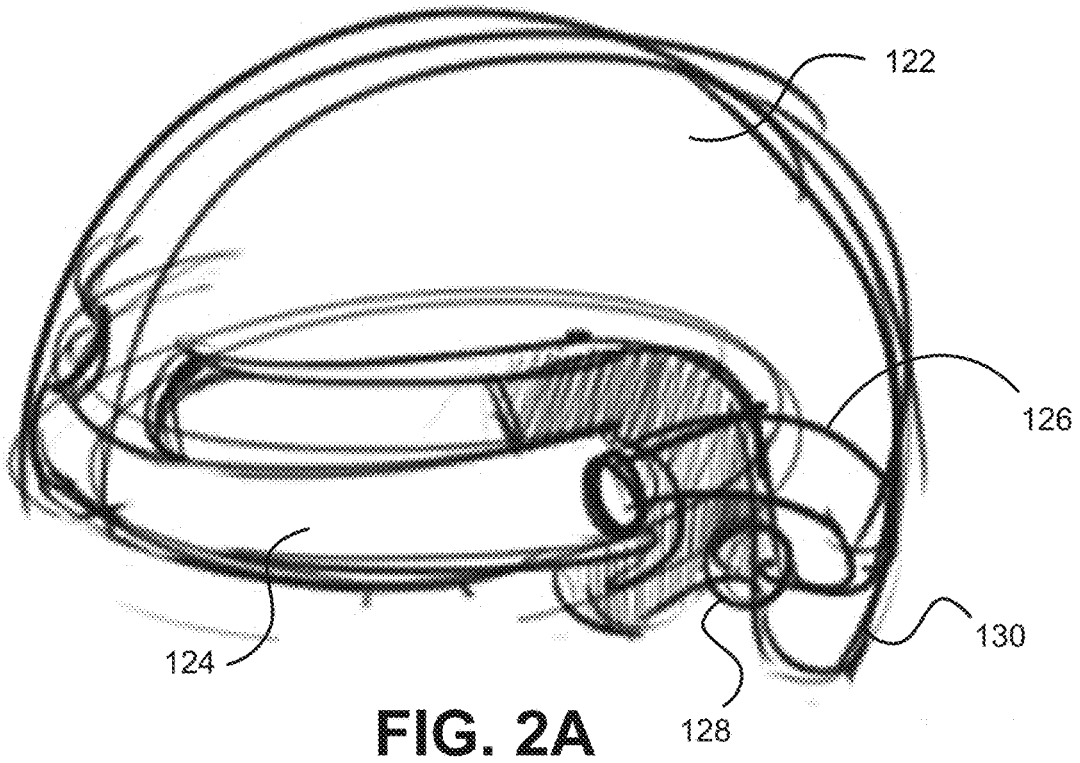
FIGS. 2A-B illustrate an alternative embodiment of a helmet protective layer.

FIG. 2A illustrates another embodiment of a helmet protective layer 122 that includes a reel based device 128. The helmet protective layer 122 includes a pair of elongate fingers 124 that wrap circumferentially around the wearer's head from the front of the helmet protective layer 122 toward the rear of the helmet protective layer 122. The elongate fingers 124 may be free floating components that are essentially disconnected from the helmet protective layer 122 along a longitudinal length of the fingers 124, or they may be coupled with the helmet protective layer 122 in a manner that allows the fingers 124 to move and flex in relation to the helmet protective layer 122. A distal end of the elongate fingers 124 is attached to lace 126 that is in turn coupled with the reel based device 128. Operation of the reel based device 128 causes the elongate fingers 124 to compress against the side of the wearer's head and may also cause the rearward portion 130 of the helmet protective layer 122 to move inward against the rear of the wearer's head. The reel based device 128 is coupled with the rearward portion 130 of the helmet protective layer 122 so that the reel based device 128 is accessible to a user.

Figure 2B:
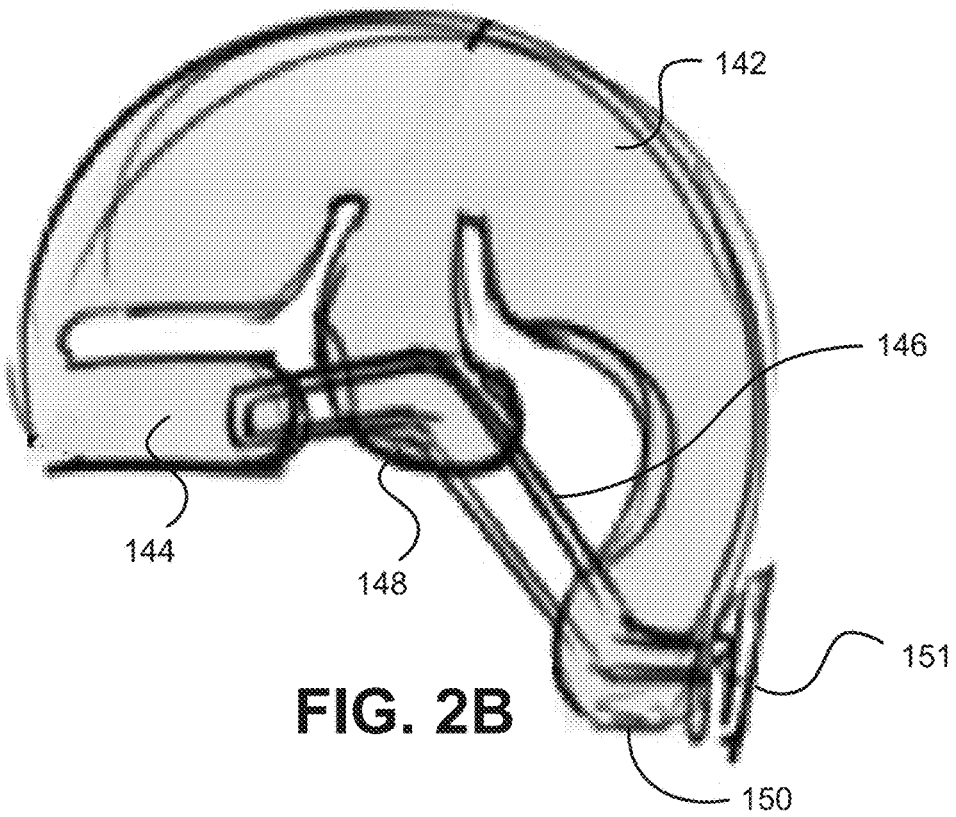

FIG. 2B illustrates an alternative embodiment of a helmet protective layer 142, which as described above is also referred to as a liner or shell. The helmet protective layer 142 is coupleable with a helmet so that when coupled with the helmet, the helmet protective layer 142 is positioned on an interior surface of the helmet. The helmet protective layer 142 is shaped to correspond to the helmet and is made of a low-friction material. The helmet protective layer 142 is coupled with the helmet so that the helmet protective layer 142 is moveable relative to the helmet responsive to a force or an impact that is exerted on the helmet.

The helmet protective layer 142 includes an intermediate member 148 that is positioned between a front support member or elongate finger 144 (hereinafter elongate finger 144) and a rear support member or rearward portion 150 (hereinafter rearward portion 150). The elongate finger 144 is spaced apart from the rearward portion 150 by a gap and the intermediate member 148 is positioned in the gap. The intermediate member 148 aids in directing or routing a tension member or lace 146 about the helmet protective layer 142 and to and from the reel based device 151. The intermediate member 148 also aids in constricting the helmet protective layer 142 about the wearer's head. As illustrated in FIG. 2B, the elongate finger 144 typically includes a lace guide that is positioned on a distal end of the elongate finger. The lace guide routes or directs the tension member 146 about the distal end of the elongate finger 144. The lace guide may be a temple guide that is configured to be positioned near the temple of a wearer's head.

The tension member 146 is coupled to the elongate finger 144 and to the rearward portion 150 across the gap between the elongate finger 144 and the rearward portion 150. The reel based device 151 is configured to adjust a tension of the tension member 146. The intermediate member 148 is configured to engage the tension member 146 between the elongate finger 144 and the rearward portion 150. The intermediate member 148 includes at least one lace guide within which the tension member 146 slides as the tension of the tension member is adjusted. In some embodiments, the intermediate member 148 includes an attachment portion that is configured to couple the intermediate member 148 to the helmet protective layer 142. In other embodiments, the intermediate member 148 is integrally formed with the helmet protective layer 142 as illustrated in FIG. 2B. The intermediate member 148 is configured so that tensioning the tension member 146 causes the intermediate member 148 to move inwardly and apply a tightening force to a wearer's head. As illustrated in FIG. 2B, in some embodiments, the intermediate member 148 includes a first tension member path and a second tension member path that is separated from the first tension member path. In some embodiments, the tension member may form a single loop that extends across a right side of the helmet protective layer 142 and across a left side of the helmet protective layer 142. The single loop may provide a dynamic fit between the right side and the left side.

Figure 10A:
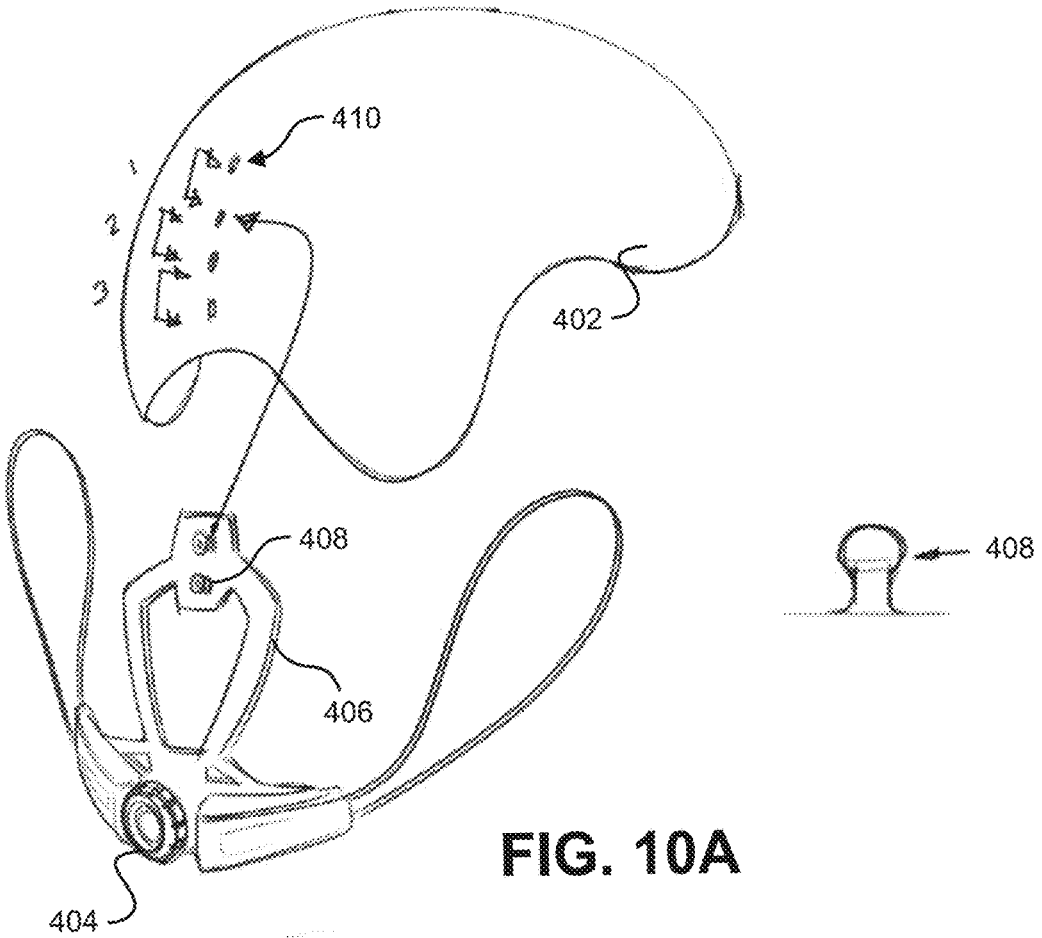
FIGS. 10A-B illustrate a rear support member or yoke that is removably coupleable with a helmet protective layer.
Figure 10B:
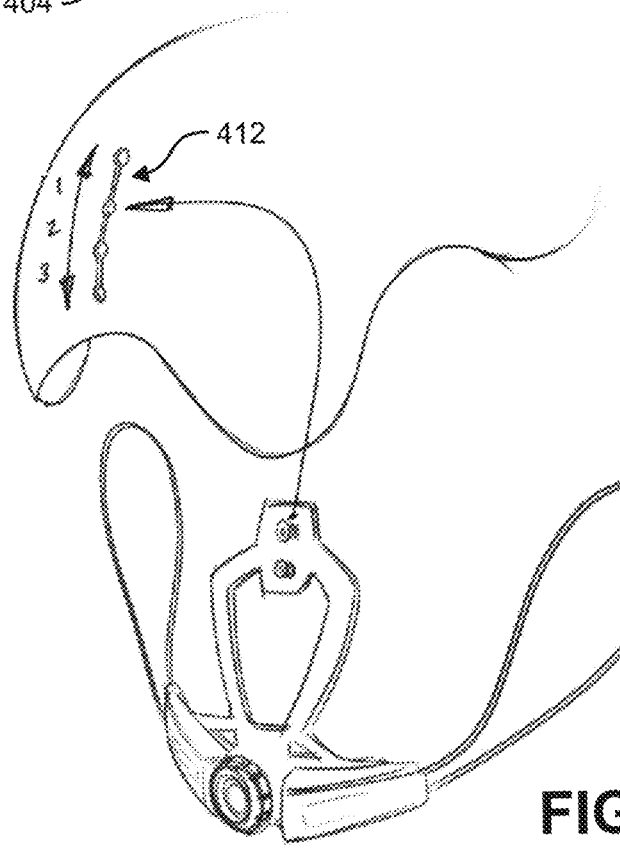

In some embodiments, the rear support member or rearward portion 150 is removably coupleable with the helmet protective layer 142. The rearward portion 150 may be a yoke that is configured to engage the back of the wearer's head. The yoke and its attachment to the helmet protective layer is illustrated in greater detail in FIGS. 10A-B. The description of FIGS. 10A-B is directly relevant to the embodiment illustrated in FIG. 2B and described herein. Thus, it should be realized for purposes of this description, and for the claims, that the illustration and description of FIGS. 10A-B is intended to be combined with the embodiment of FIG. 2B. As such, the entire description of FIGS. 10A-B are equally relevant and applicable to FIG. 2B.

As illustrated in FIGS. 10A-B, the yoke 406 includes an engagement member that is configured to couple with a corresponding engagement member of the helmet protective layer 402 to couple the yoke 406 to the helmet protective layer 402. In the illustrated embodiment, the engagement member of the yoke 406 is at least one boss or protrusion 408 and the engagement member of the helmet protective layer 402 is at least one aperture 410. The yoke 406 is adjustable relative to the helmet protective layer 402 so that a position of the yoke 406 about the wearer's head may be adjusted by adjusting the position of the yoke 406 relative to the helmet protective layer 402. To enable such adjustment, the helmet protective layer 402 may include a plurality of apertures 410 within which the boss or protrusion 408 of the yoke 406 is positionable. In such embodiments, the yoke 406 may be adjusted relative to the helmet protective layer 402 by repositioning the boss or protrusion 408 within a different one of said plurality of apertures 410.

Figure 3A:
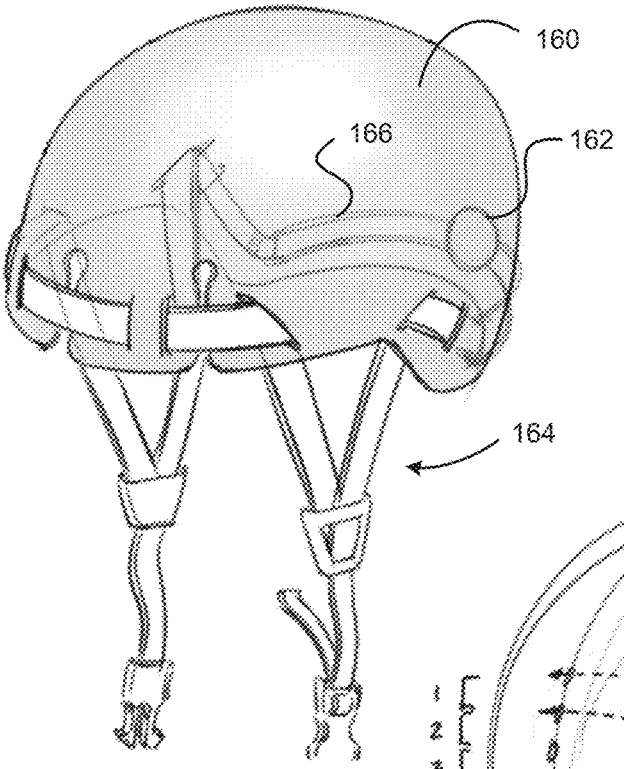
FIGS. 3A-C illustrate an embodiment in which a helmet protective layer includes a pair of straps that a wearer buckles under their chin to secure the helmet protective layer to the wearer's head.
Figure 3C:
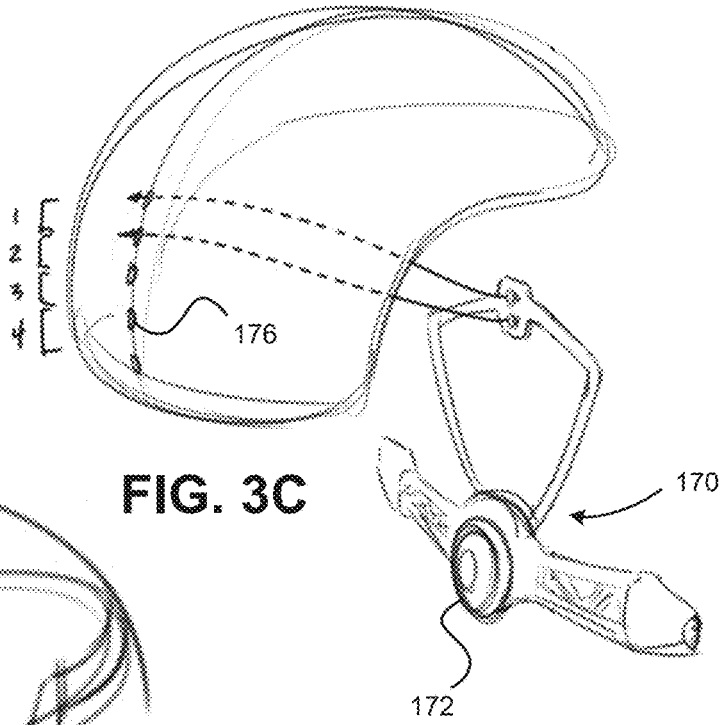
Figure 3B:
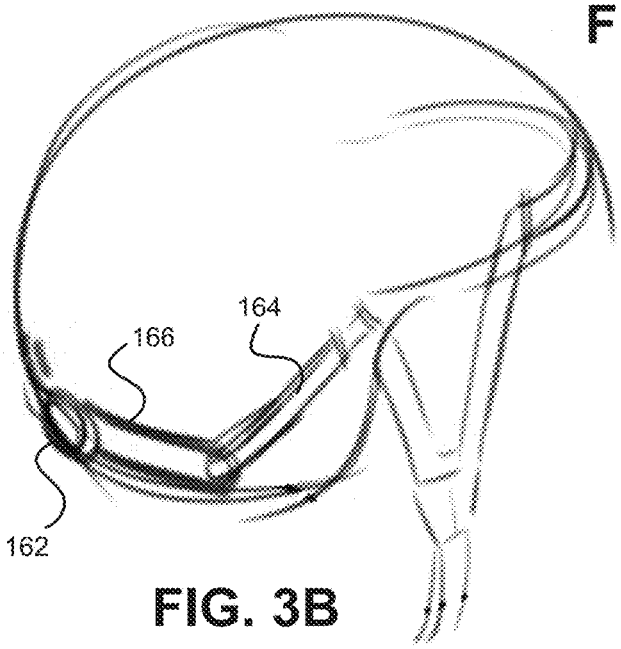

FIGS. 3A-C illustrate an embodiment in which the helmet protective layer 160 includes a pair of straps 164 that a wearer buckles under their chin in order to secure the helmet protective layer 160 to the wearer's head. The helmet protective layer 160 also includes a reel based device 162 that is positioned on the rearward portion of the helmet protective layer 160 and that is operatively coupled with a tension member 166 so that an operation of the reel based device 162 tensions the tension member 166. The tension member 166 is attached to opposing distal ends of the straps 164 so that tensioning of the tension member 166 adjusts the tension in the straps 164 and thereby adjusts the fit of the helmet protective layer 162 about the wearer's head. In some embodiments, the tension member 166 may be simultaneously coupled with the distal end of the straps 164 and with a front portion of the straps so that tensioning of the tension member 166 simultaneously adjust the tension in the distal end and the front portion of the straps.

As described in greater detail in FIGS. 10A-B, the reel based device 172 may be attached to a yoke 170 that is removably coupleable with the helmet protective layer. The yoke 170 may include bosses that snap into engagement with apertures 176 positioned on the helmet protective layer. The apertures 176 may be simply through holes or may include relief cuts to enable the bosses to more easily be attached and/or detached from the helmet protective layer.

Figure 4A:
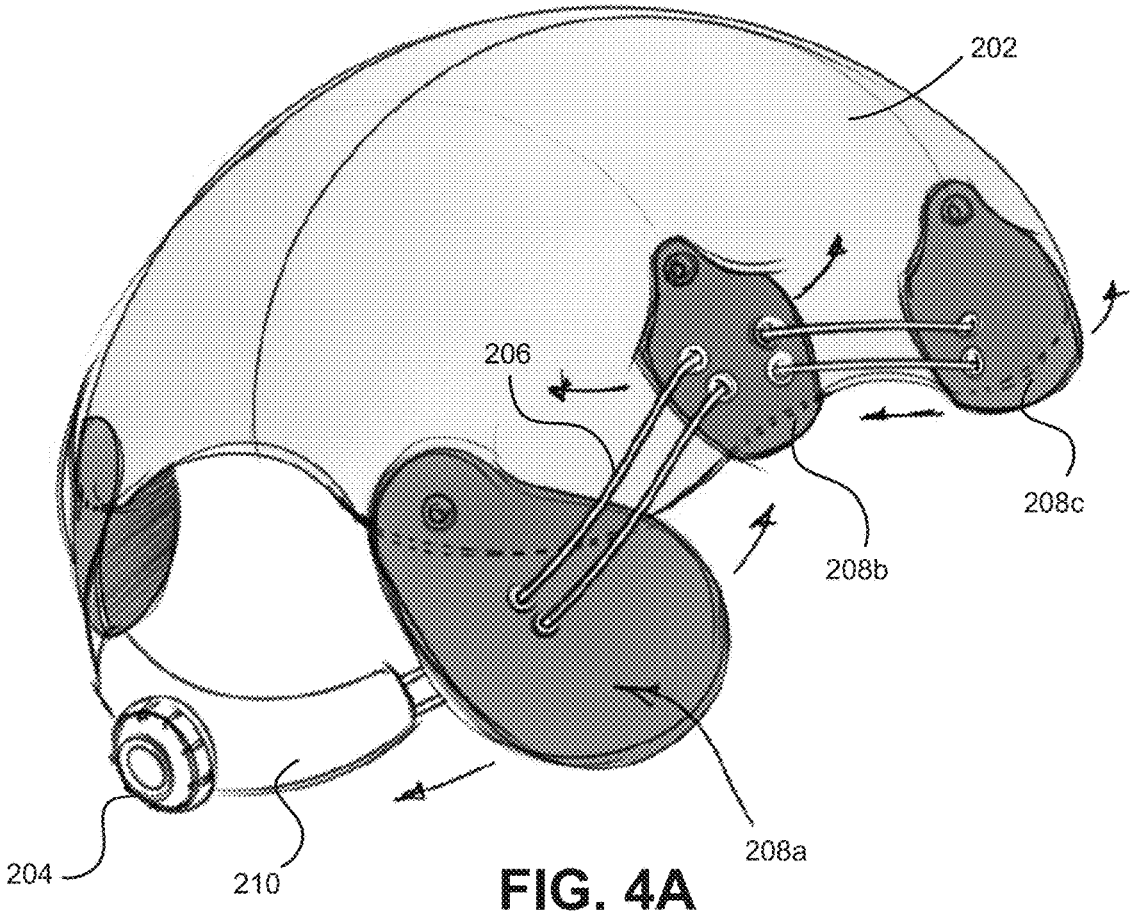
FIGS. 4A-C illustrate another embodiment of a helmet protective layer.
Figure 4B:
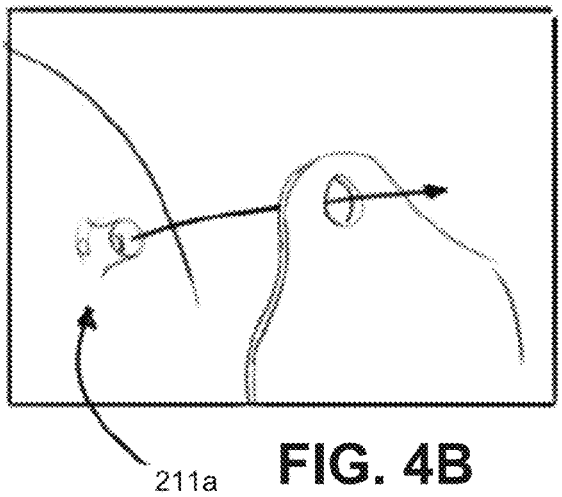
Figure 4C:
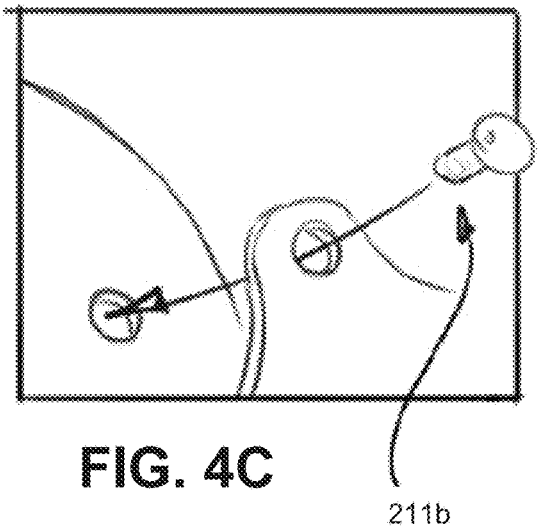

FIGS. 4A-C illustrate a helmet protective layer 202 that includes a reel based device 204 and tension member 206 as previously described. The reel based device 204 may be coupled with a rear member 210. The helmet protective layer 202 also includes one or more flexible panels 208*a-c* that are attached to the helmet protective layer 202. In the illustrated embodiment, the panels 208*a-c* are configure to pivot or rotate about the helmet protective layer 202. The tension member 206 is guided or directed about the helmet protective layer 202 via the panels 208*a-c*. Tensioning of the tension member 206 causes one or more of the panels 208*a-c* to pivot or rotate about the helmet protective layer 202 and/or causes one or more of the panels 208*a-c* to constrict inward against the surface of the wearer's head. The fit of the helmet protective layer 202 about the wearer's head may be customized or tailored by employing panels that pivot and/or move radially inward in a desired manner as the tension member 206 is tensioned. The shape of the individual panels 208*a-c* may be customized based on the desired fit of the helmet protective layer 202. For example, the panels 208*a-c* may have elongated finger like configurations, may have circular or oval shaped configurations, or any other desired geometry. As illustrated in FIGS. 4B-C, the panels 208*a-c* may be riveted 211*a-b* to the helmet protective layer 202 and/or attached using any known attachment method. The use of the panels 208*a-c* may allow the helmet protective layer 202 to constrict about the wearer's head without buckling or folding the helmet protective layer material.

Figure 5A:
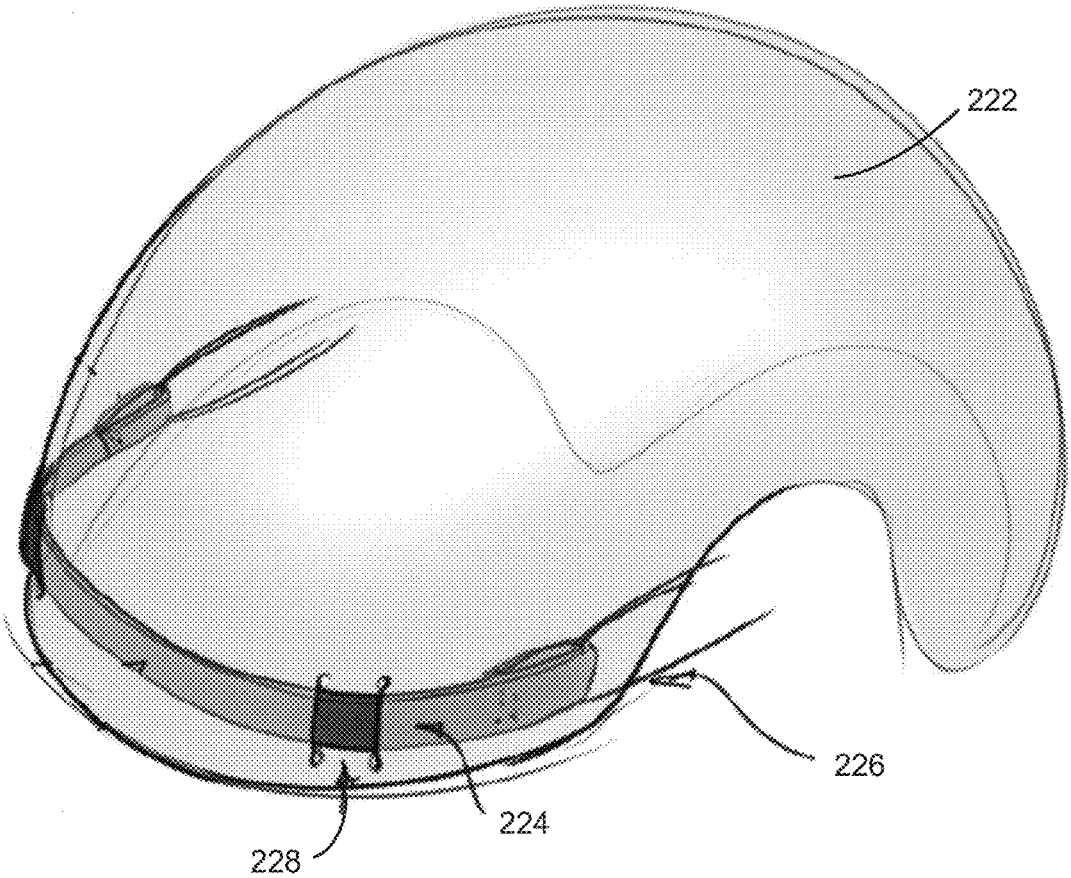
FIGS. 5A-B illustrate a helmet protective layer that employs a strap that is tensioned by a tension member that is operatively coupled with a reel based device.
Figure 5B:
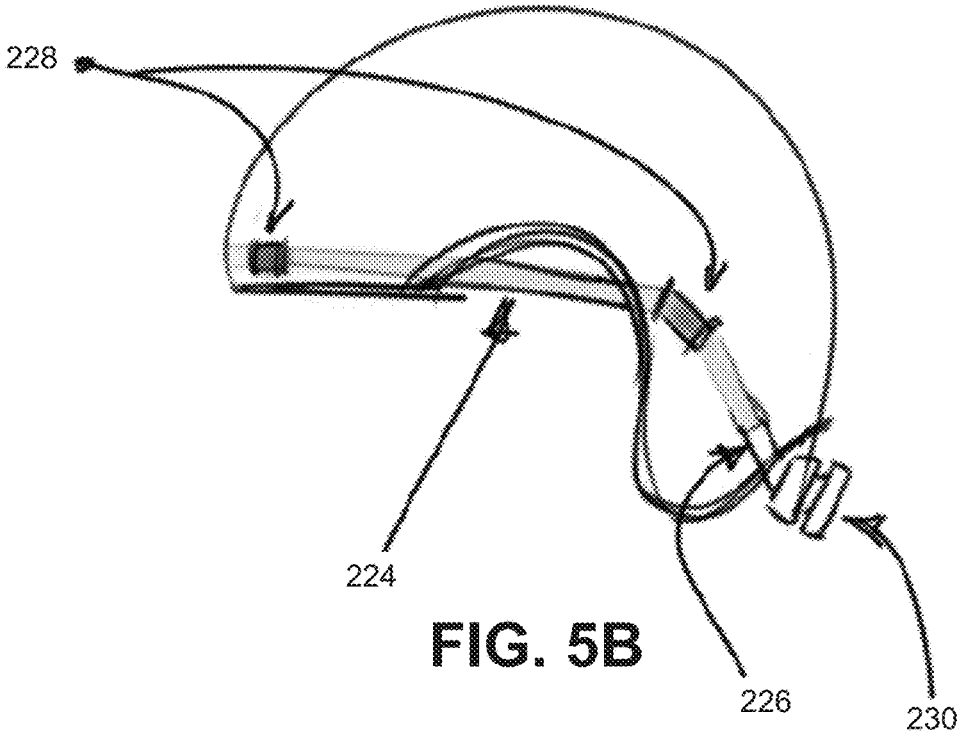

FIGS. 5A-B illustrate a helmet protective layer 222 that employs a strap 224 that is tensioned by a tension member 226 that is operatively coupled with a reel based device 230. Tensioning of the tension member 226 causes the strap 224 to constrict about the wearer's head and causes the helmet protective layer 222 to also constrict about the wearer's head. In one embodiment the strap 224 is attached to the helmet protective layer 222 via slot pairs that form a loop 228 within which the strap 224 is inserted. The strap 224 may be positioned within the helmet protective layer 222 so that it wraps circumferentially around the wearer's head. The tension member 226 is coupled with the distal end of the straps 224 and is configured to pull the strap 224 rearward as the tension member 226 is tensioned via the reel based device 230. Loops may be formed in the distal ends of the straps 224 through which the tension member 226 is inserted. In other embodiments, a guide member may be attached to the distal end of the straps 224 for guiding or directing the tension member about the helmet protective layer 222. In some embodiments, the straps 224 may directly contact the side of the wearer's head. In such embodiments, a padding or cushion member is typically coupled with the straps 224 to minimize any discomfort in wearing the helmet system.

Figure 6A:
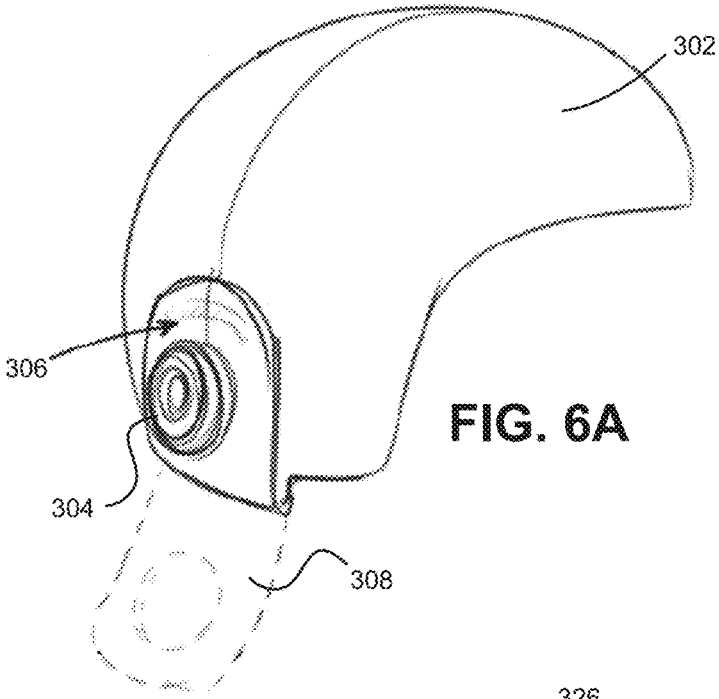
FIGS. 6A-F illustrate embodiments of coupling a reel based device with the helmet protective layer.
Figure 6B:
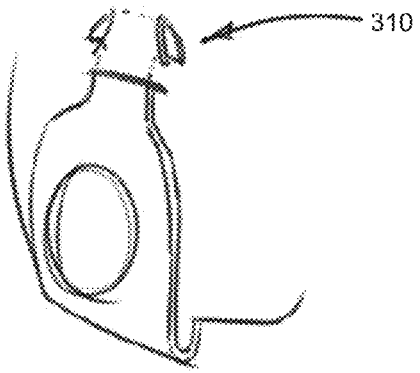
Figure 6C:
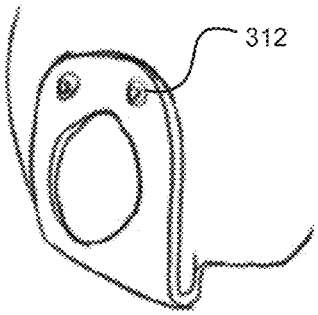

FIGS. 6A-F illustrate embodiments of coupling a reel based device with the helmet protective layer. In one embodiment, the helmet protective layer 302 includes a flap 306 that is foldable over the reel based device 304. The flap 306 is attached to the helmet protective layer 302 after being folded over the reel based device 304 in order to encase or sandwich the reel based device between the helmet protective layer 302 and the flap 306. In particular, the flap 306 may initially be folded down and extend from the rearward portion of the helmet protective layer 302 as shown by the dashed lines 308 in FIG. 6A. The reel based device 304 may be positioned on the helmet protective layer 302 and the flap 306 may then be folded over the reel based device 304 and attached to the helmet protective layer 302. The flap 306 includes a central hole or aperture through which the knob of the reel based device is positioned after the flap 306 is folded over the reel based device. As illustrated in FIG. 6B, in some instances, the flap 306 could include one or more tabs 310 that are insertable within slots of the helmet protective layer 302 in order to secure the flap 306 in the folded position. As illustrated in FIG. 6C, the flap 306 could include snaps 312 that snap together to secure the flap 306 in the folded position. In yet other instances, the flap 306 could be heat welded, adhesively bonded, or otherwise coupled to the helmet protective layer 302.

Figure 6D:
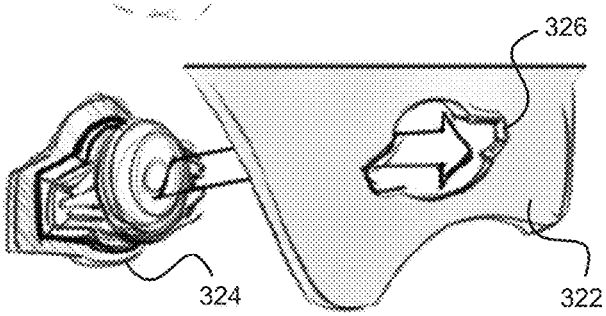
Figure 6E:
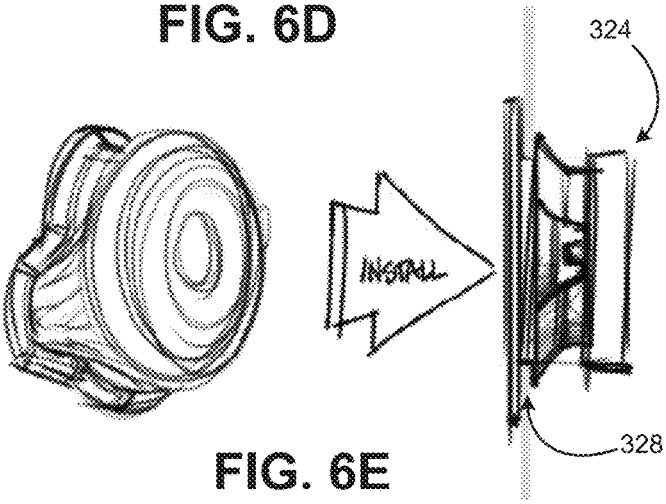

As illustrated in FIGS. 6D-E, the helmet protective layer 322 may include an aperture or hole 326 through which the reel based device 324 is inserted and secured. The aperture 326 may be shaped and sized to correspond with the shape and size of the reel based device 324. The aperture 326 may be slightly smaller in size than a rearward surface of the reel based device 324 so that an interference fit occurs as the reel based device 324 is inserted through the aperture 326 of the helmet protective layer 322. The reel based device 324 may include a channel 328 in which the layer of the helmet protective layer 322 is positioned after the reel based device is inserted through the aperture 326 of the helmet protective layer 322.

Figure 6F:
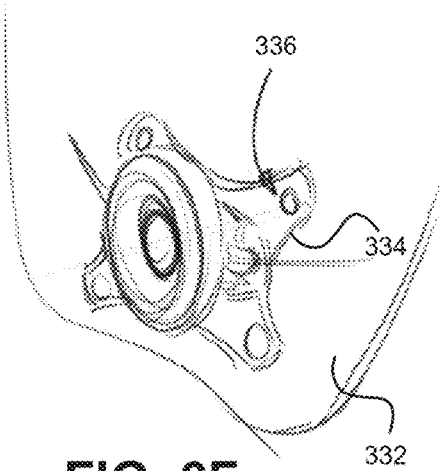

As illustrated in FIG. 6F, the reel based device 334 may be directly coupled to the exterior of the helmet protective layer 332. For example, the reel based device 334 may be heat staked 336, riveted, adhesively bonded, RF or sonically welded, and the like to the exterior surface of the helmet protective layer 332.

Figure 7A:
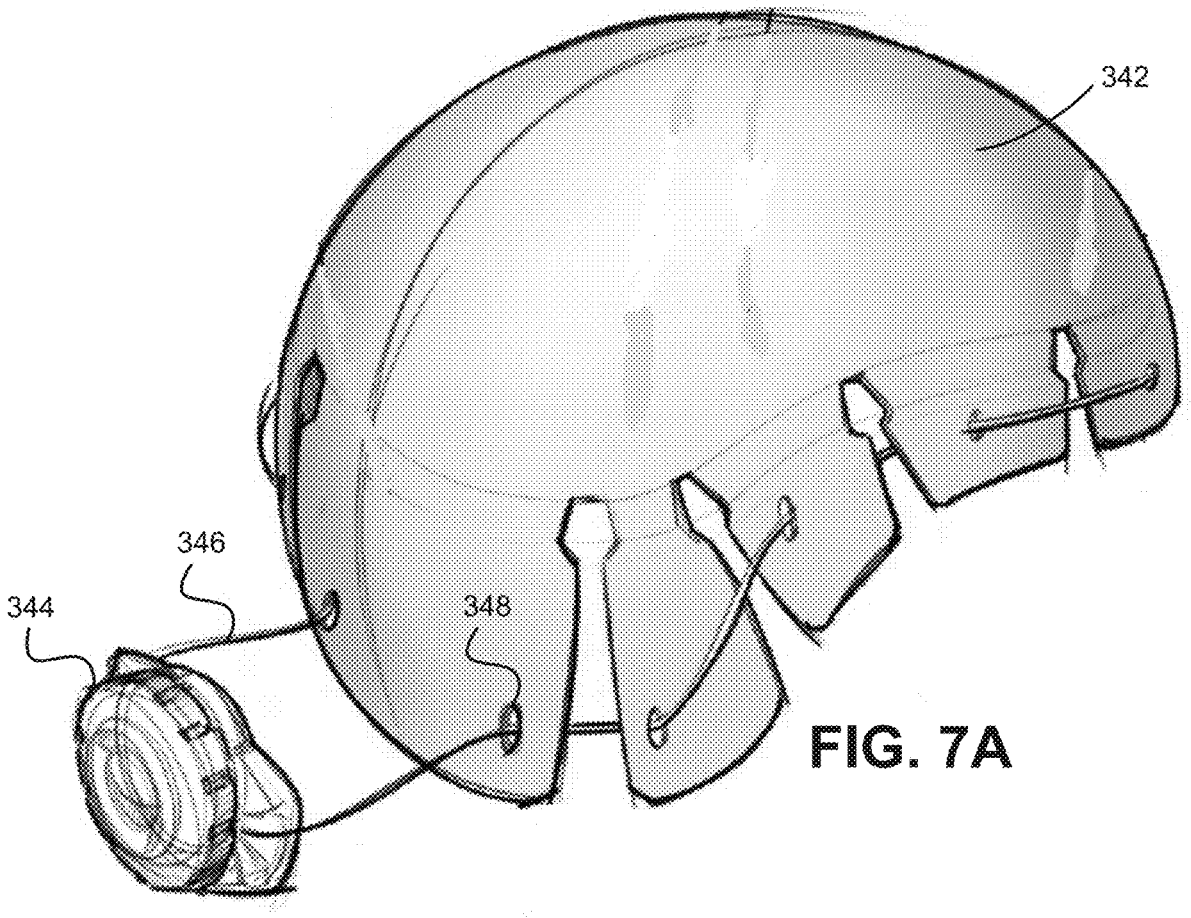
FIGS. 7A-B illustrate other embodiments of attaching a reel based device to the helmet protective layer.
Figure 7B:
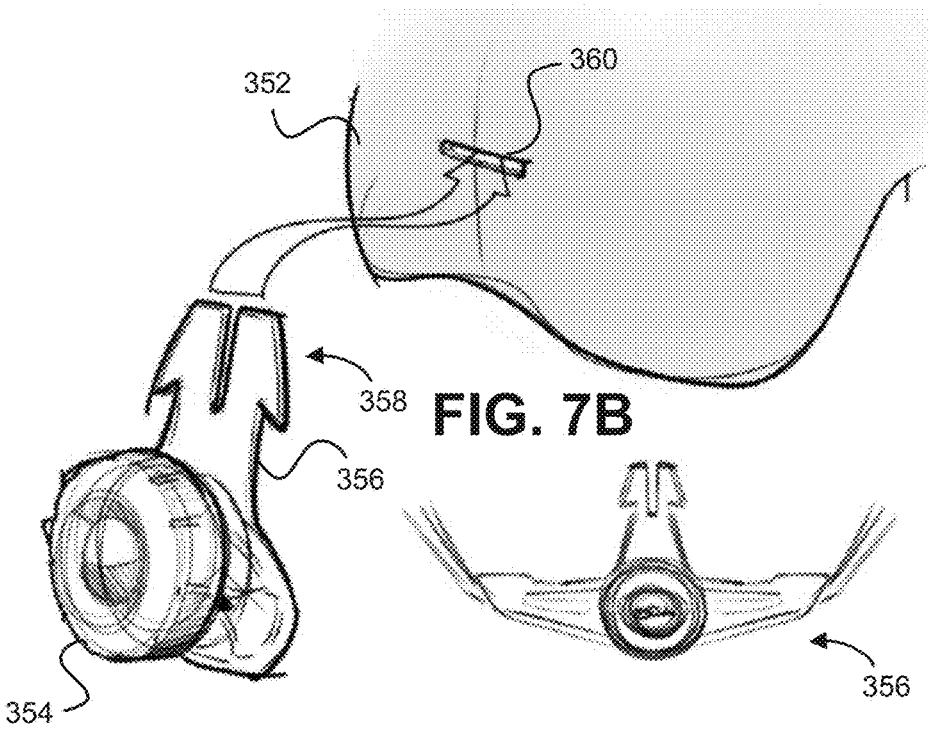

FIGS. 7A-B illustrate other embodiments of attaching the reel based device to the helmet protective layer. As illustrated in FIG. 7A, the reel based device 344 may be "free floating" about or relative to the helmet protective layer 342. Free floating as used herein means that the reel based device is not fixedly or directly attached to the helmet protective layer 342. Rather, the reel based device 344 is indirectly attached to the helmet protective layer 342. In the illustrated embodiment, the reel based device 344 is indirectly attached to the helmet protective layer 342 via the tension member 346. In particular, the tension member 346 is inserted through holes or apertures 348 that are formed in the helmet protective layer 342. The holes or apertures 348 may be formed in the distal end of a rearward elongate finger(s) of the helmet protective layer 342, or elsewhere as desired. The opposing distal ends of the tension member 346 may be attached to the helmet protective layer 342, or may be coupled together, near a forward portion or elongate finer of the helmet protective layer 342.

The insertion of the tension member 346 through the apertures 348 couples the reel based device 344 with the helmet protective layer 342. Tensioning of the tension member 346 pulls the reel based device 344 into contact with the helmet protective layer 342. Further tensioning of the tension member 346 will cause the helmet protective layer 342 to constrict about the wearer's head. The tension member 346 may be inserted through apertures of various elongate fingers as illustrated to couple the tension member 346 with the elongated manner so that tensioning of the tension member 346 causes the elongate fingers to constrict about the wearer's head.

As illustrated in FIG. 7B, the reel based device 354 may be attached to a yoke 356, which is a component that is independent of the helmet protective layer 352 and that is configured to house the reel based device 354 and, in some instances, a portion of the tension member. The use of the yoke 356 may allow the reel based device 354 to extend downward from the helmet protective layer 352 so that it is more easily accessible to the wearer. The use of the yoke 356 may also provide a more rigid base that functions as an anchor point for the reel based device 354. The yoke 356 includes a forked end 358 that is insertable within a slotted aperture 360 of the helmet protective layer 352 to couple the yoke 356 to the helmet protective layer 352. The forked end 358 is one way insertable within the slotted aperture 360 in order to prevent or substantially impede removal of the yoke 356 from the helmet protective layer 352.

Figure 8:
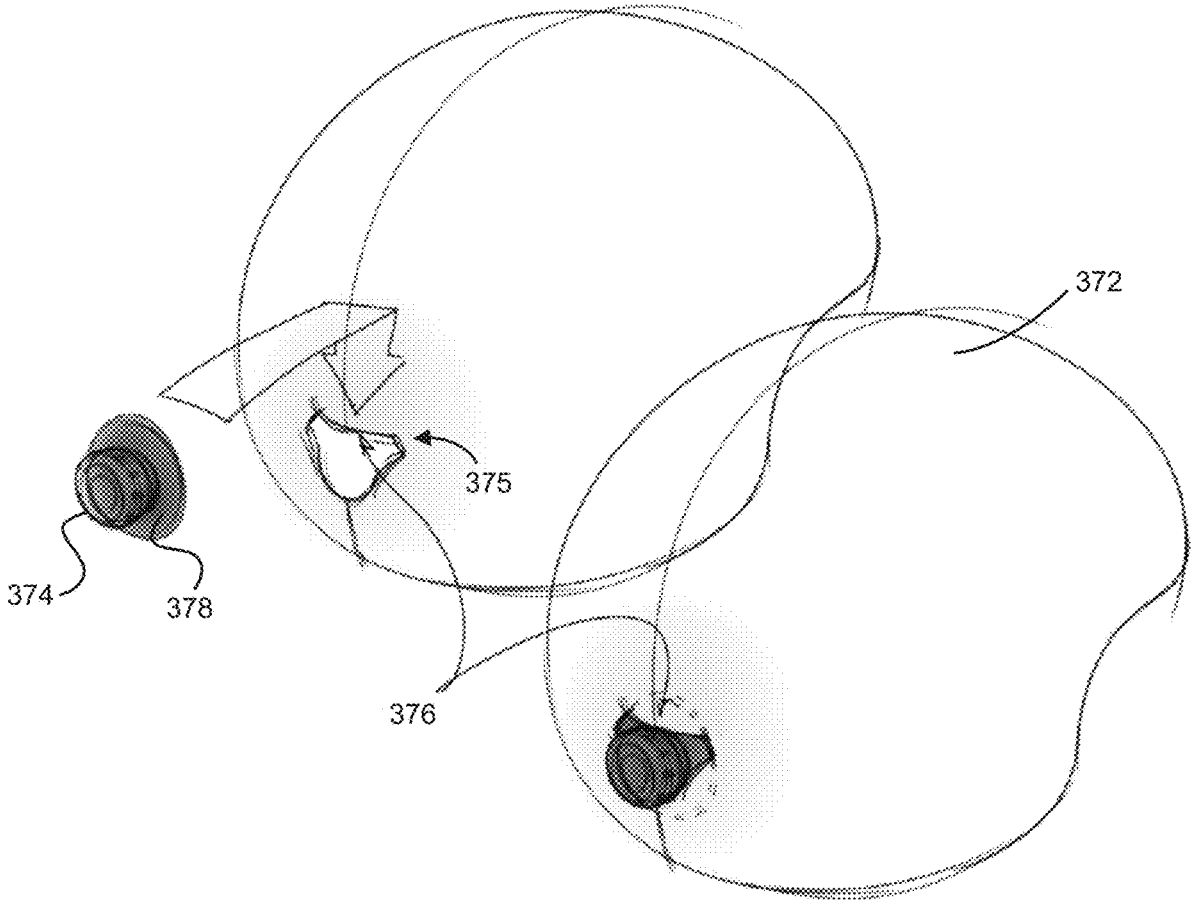
FIG. 8 illustrates an alternative embodiment of coupling a reel based device with a helmet protective layer.

FIG. 8 illustrates an alternative embodiment of coupling a reel based device 374 with a helmet protective layer 372. Specifically, the helmet protective layer 372 includes a hole or aperture 375 that defines a plurality of slotted ends 376. In the illustrated embodiment, the aperture 375 defines 3 slotted ends 376. The reel based device 374 includes a base having a tab 378 that extends around a portion of the periphery of the base. In the illustrated embodiment, the tab 378 extends around the entire periphery of the base. The reel based device's tab 378 and the aperture's slotted ends 376 are designed so that the tab 378 may be inserted under the slotted ends 376 while remaining sufficiently strong so as to greatly impede removal of the reel based device 374 by pulling the reel based device orthogonally relative to the aperture 375.

Figure 9:
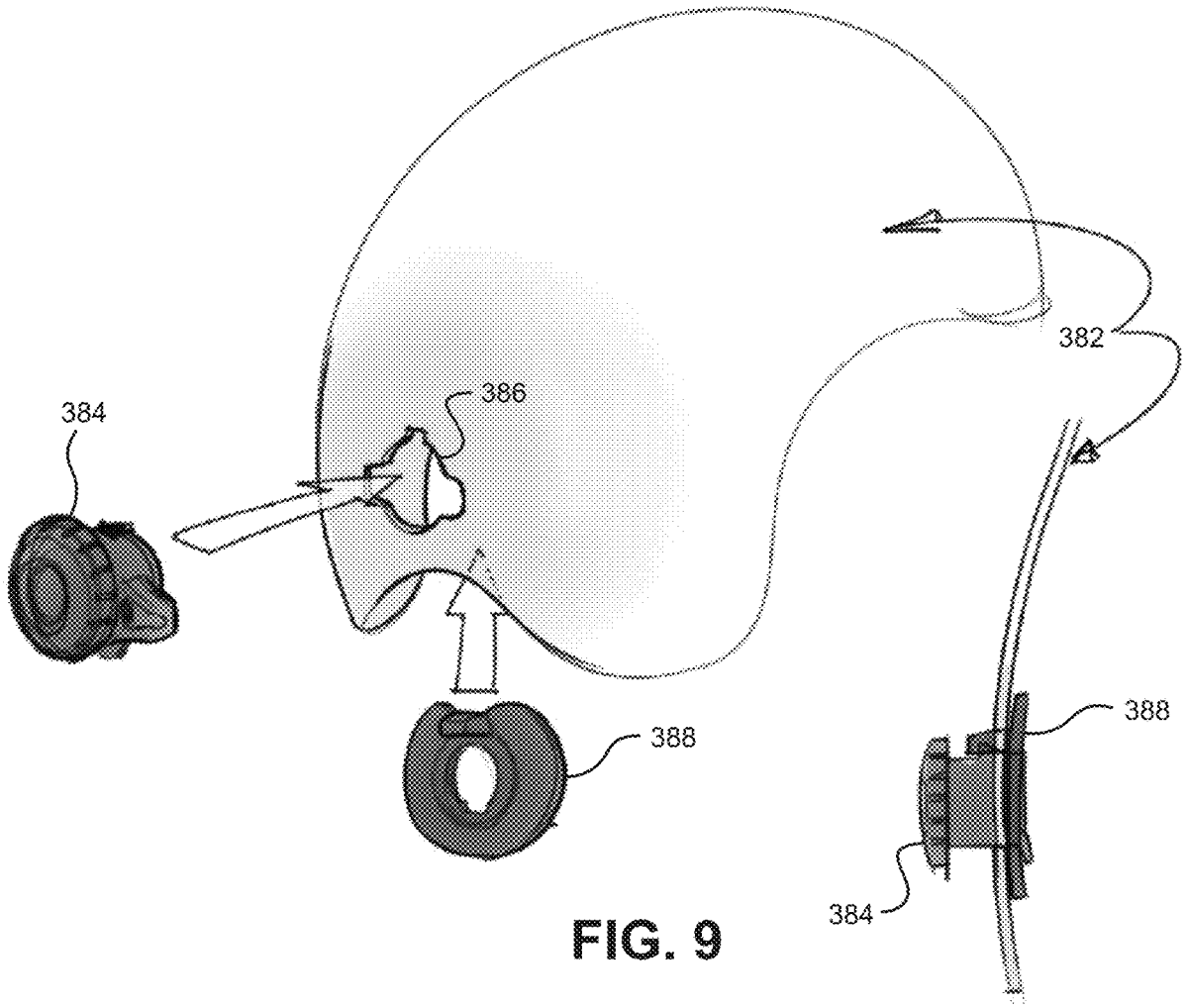
FIG. 9 illustrates an embodiment of coupling a reel based device with a helmet protective layer in a manner similar to that of FIG. 8.

FIG. 9 illustrates an embodiment of coupling a reel based device 384 with a helmet protective layer 382 that is similar to the embodiment of FIG. 8. The embodiment of FIG. 9, however, employs a base member 388 that is positioned on an opposite side of the hole or aperture 386 from the reel based device 384. The aperture 386 is shaped and sized so that a bottom surface or portion of the reel based device 384 is insertable through the aperture 386 while a top portion of the reel based device 384 is prevented from being inserted through the aperture 386. The base component 388 is configured to couple or attach to the bottom portion of the reel based device 384 that is inserted through the aperture 386. In this manner the reel based device 384 and the base component 388 may be attached together with the helmet protective layer 382 sandwiched between these two components, which locks or fixedly secures the reel based device 384 to the helmet protective layer 382. In some instances a portion of the base component 388 may be insertable through the aperture 386 to aid in coupling the reel based device 384 to the helmet protective layer 382.

FIGS. 10A-B illustrate a rear support member or yoke 406 that is removably coupleable with the helmet protective layer 402 (i.e, the liner or shell). The reel based device 404 is attached to the yoke 406, which is designed and configured to house the reel based device 404 and/or provide a more rigid anchor point for the reel based device 404. The yoke 406 includes an engagement member that is configured to couple with a corresponding engagement member of the helmet protective layer 402 in order shell to couple the yoke 406 to the rear portion of the helmet protective layer 402. Specifically, an upper portion of the yoke 406 includes one or more bosses 408 (e.g., a pair of bosses) that are insertable within apertures 410 of the helmet protective layer 402. The bosses 408 may be snapped into and out of the apertures 410 of the helmet protective layer 402 in order to attach and/or remove the yoke 406 and reel based device 404 from the helmet protective layer 402. The removability of the yoke 406 and reel based device 404 may allow for an appropriate reel based device 404 to be selected and used based on one or more needs of the helmet protective layer 402.

As illustrated in FIGS. 10A-B, the helmet protective layer 402 may include multiple holes 410 in order to allow for the position of the yoke 406 and reel based device 404 to be adjusted in relation to the helmet protective layer 402. For example, to reposition the yoke 406 in relation to the helmet protective layer 402, the bosses 408 may be removed from the holes 410 and the yoke 406 may be moved upward or downward about the helmet protective layer 402. The yoke 406 may then be attached to the helmet protective layer 402 by reinserting the bosses 408 within the appropriate holes 410. In the illustrated embodiment, the helmet protective layer 402 includes 4 holes 410, which enables the yoke 406 to be moved between 3 positions. In some instances the holes may be connected by a slot 412. The slot 412 enables the bosses 408 to be moved between holes without requiring the bosses to be extracted from the holes. The slot 412 is narrower than the holes and the bosses 408 in order to prevent the bosses 408 from unintentionally migrating between holes. As described herein, the reel based device 404 is operably coupled with a tension member. The reel based device 404 includes a rotatable spool and a knob that is configured to rotate the spool in response to the wearer rotating the knob. Rotation of the spool in a tightening direction winds the tension member about the spool and thereby tensions the tension member and tightens the helmet protective layer 402 about the wearer's head. In some embodiments, the tension member may form a single loop that extends across a right side of the helmet protective layer 402 and across a left side of the helmet protective layer 402, to provide a dynamic fit between the right side and the left side.

Figure 11A:
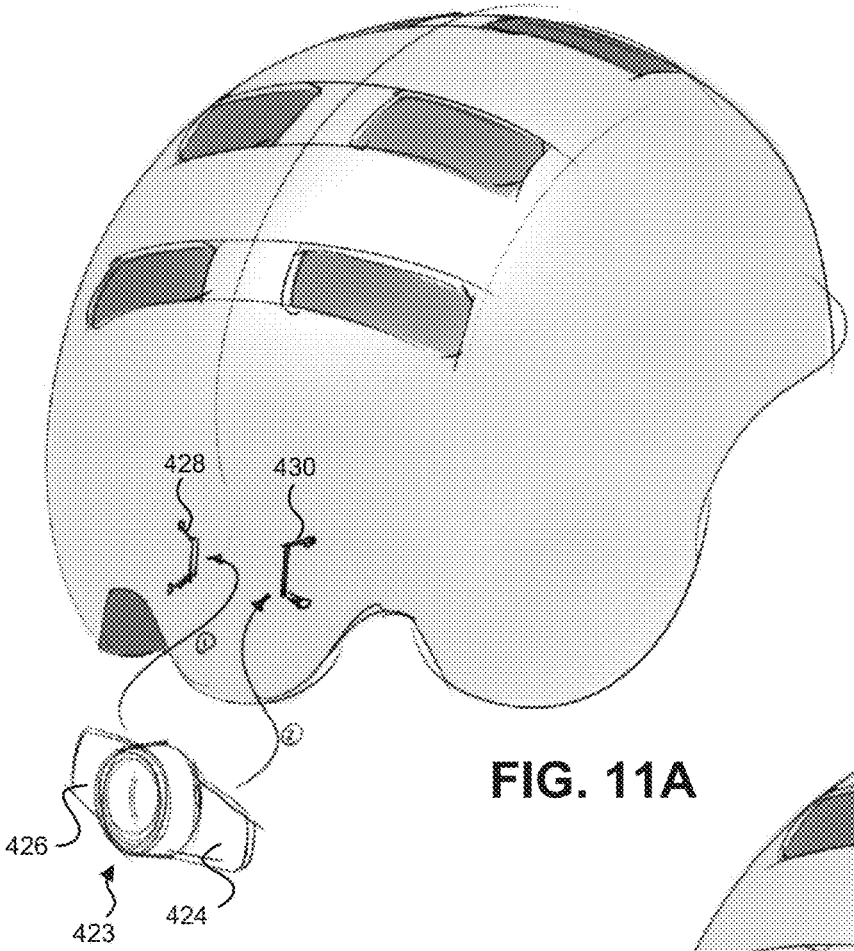
FIGS. 11A-B illustrate an embodiment of coupling a reel based device with a helmet protective layer in a manner similar to that of FIG. 8.
Figure 11B:
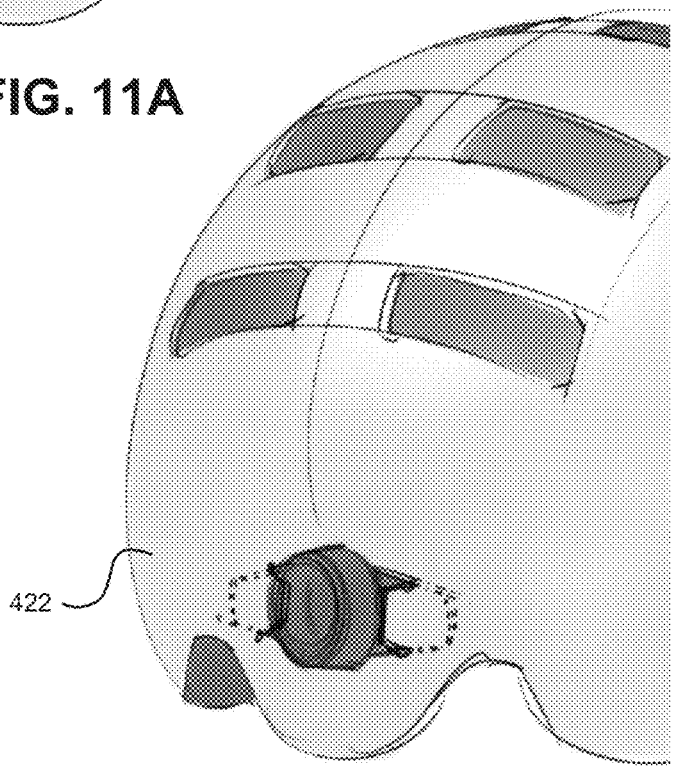

FIGS. 11A-B illustrate an embodiment of coupling the reel based device with the helmet protective layer 422 that is similar to the embodiment of FIG. 8. Specifically, a housing or base component 423 of the reel based device (not shown) includes a pair of tabs, 424 and 426, that are insertable within corresponding slots, 430 and 428, of the helmet protective layer 422. In coupling the base component 423 with the helmet protective layer 422, one of the tabs (e.g., 424) is inserted within one of the corresponding slots (e.g., 430) before the other tab (e.g., 426) is inserted within the other corresponding slot (e.g., 428). The tabs, 424 and 426, are positioned underneath the material of the helmet protective layer 422 while the main portion of the base component 423 remains positioned above the material of the helmet protective layer 422. The slots, 428 and 430, are sufficiently strong to greatly impede or prevent unwanted removal of the base component 423 from the helmet protective layer 422.

Figure 12:
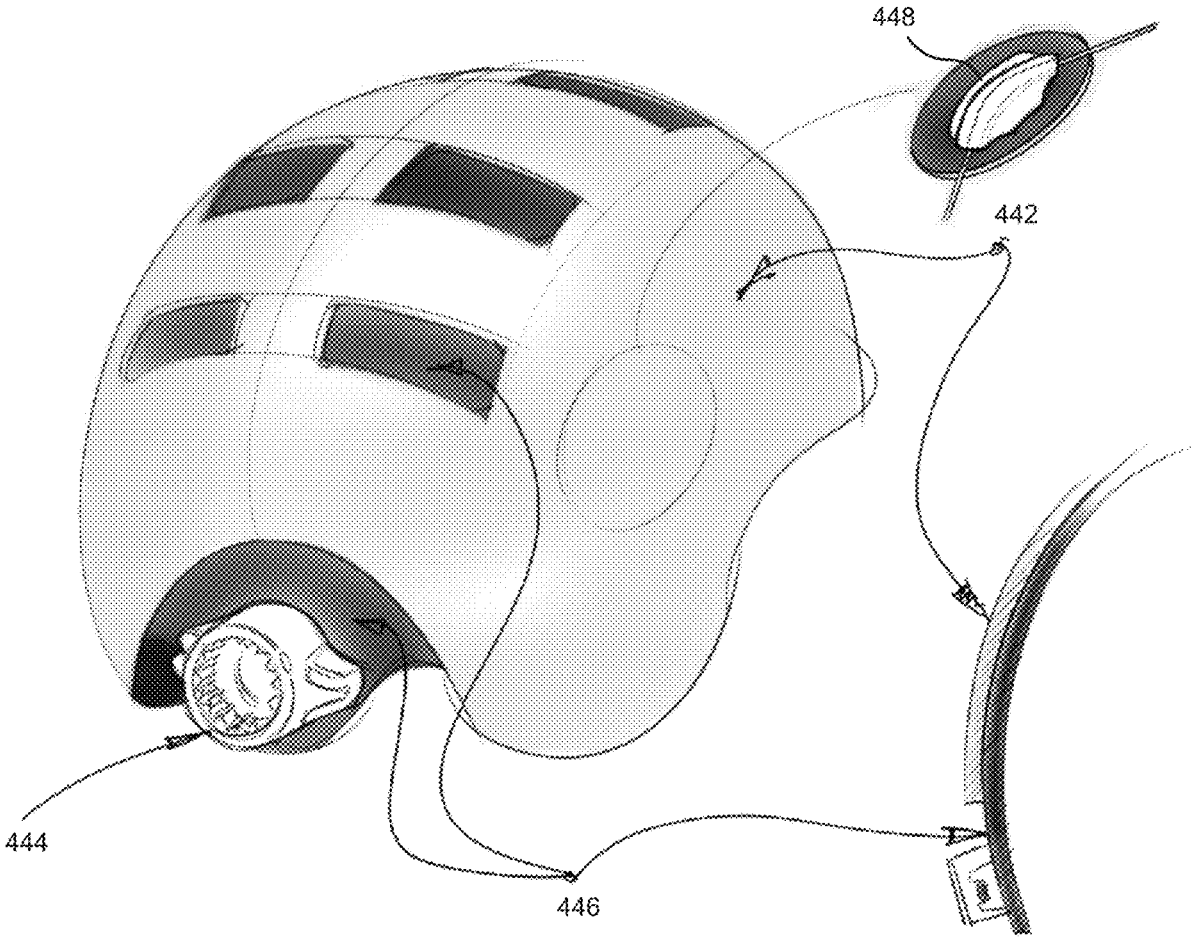
FIGS. 12-13 illustrate embodiments in which a component of a reel based device is direct injection molded onto a helmet protective layer or onto a component that is subsequently attached to the helmet protective layer.
Figure 13:
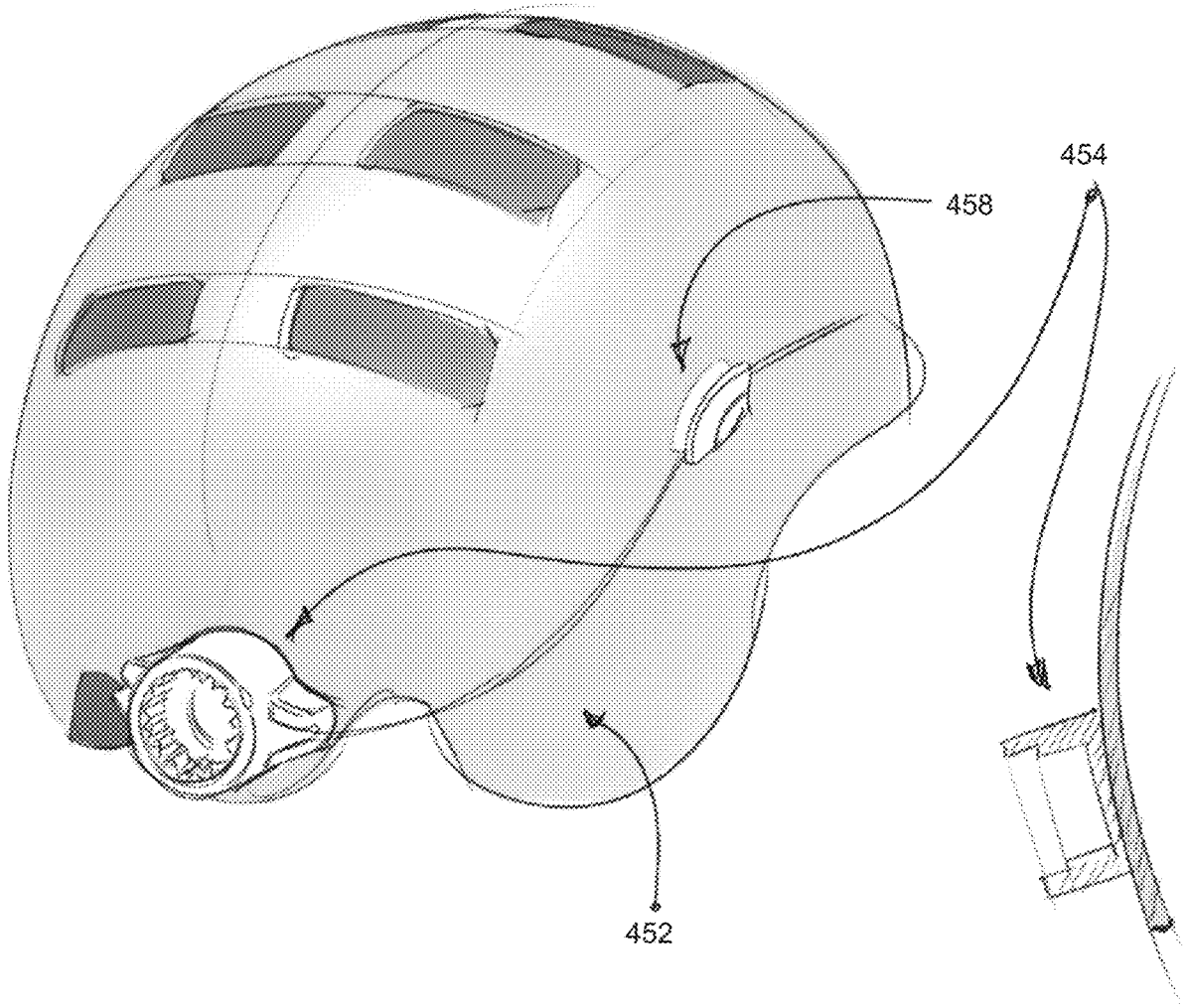

FIGS. 12 and 13 illustrate embodiments in which a component of a reel based device may be direct injection molded onto the helmet protective layer 442 or onto a component that is subsequently attached to the helmet protective layer 442. Specifically, as illustrated in FIG. 12, a base component or housing 444 of the reel based device may be direct injection molded onto a fabric material or layer 446 that is subsequently attached to the helmet protective layer 442. The fabric material or layer 446 may be a material strip that is positionable on the inner surface of the helmet protective layer 442 and that is attachable thereto via adhesive bonding, mechanical fastening (e.g., hook and loop fasteners), and the like. The direct injection molding of the base component 444 onto the fabric material or layer 446 may provide a secure attachment of the components in a manner that enables easy coupling to the helmet protective layer 442. In some instances, one or more of the guide members 448 for the tension member may be direct injection molded onto the fabric material or layer 446 that is subsequently coupled with the helmet protective layer 442.

In FIG. 13 the base component 454 is direct injection molded onto the helmet protective layer 452 rather than being direct injection molded onto an intermediate layer, such as the fabric material or layer 446 of FIG. 12. The direct injection mold of the base component 454 onto the helmet protective layer 452 itself may eliminate failure points and/or extraneous components that are often present in securing separate components together. The direct injection of the base component 454 onto the helmet protective layer 452 may also provide a fixed anchor point that minimizes or prevents relative motion of the reel based device 454 and the helmet protective layer 452. In some instances, one or more guide members 458 may likewise be direct injection molded onto the helmet protective layer 452 as desired.

Figure 14A:
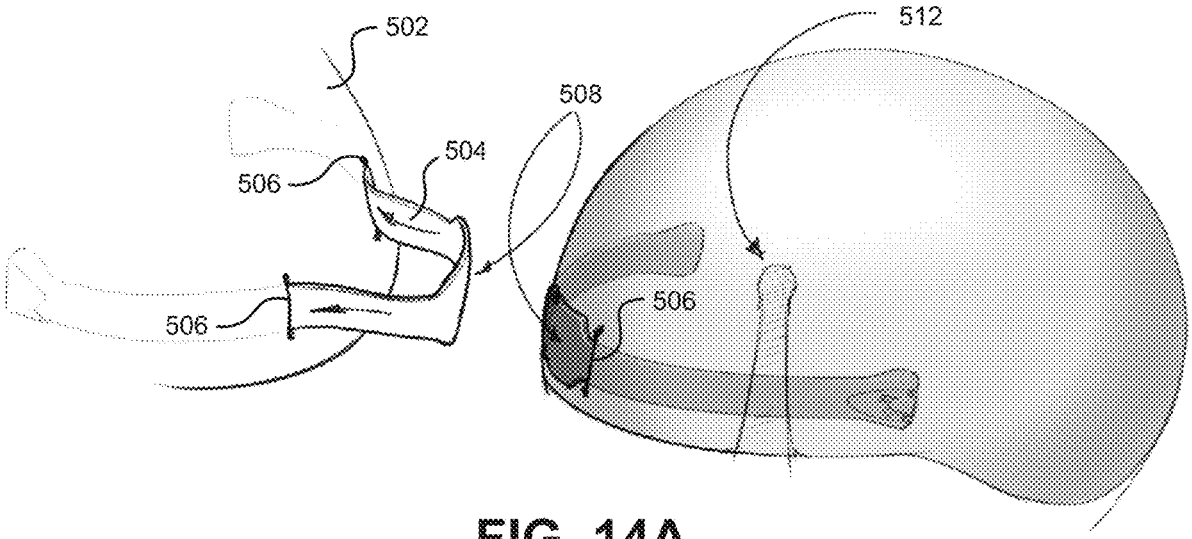
FIGS. 14A-B illustrate a method of coupling a tension component with a helmet protective layer.
Figure 14B:
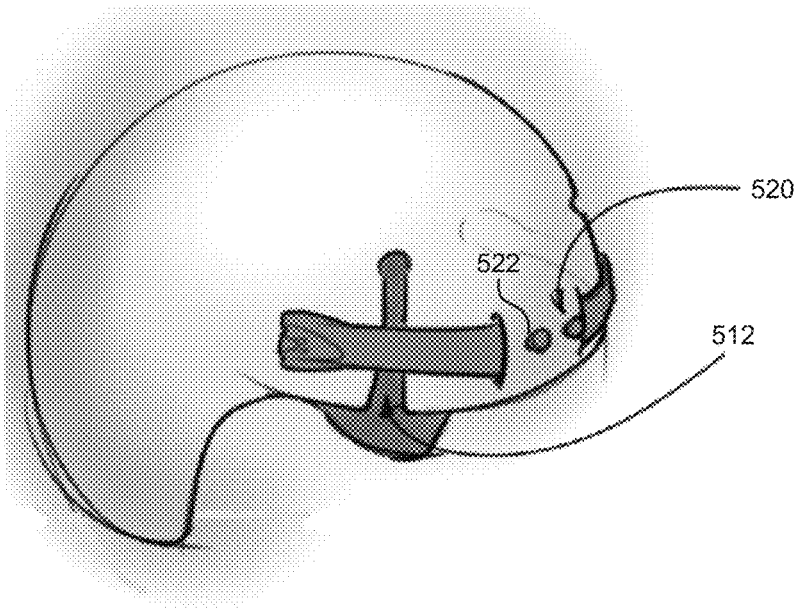

FIGS. 14A-B illustrate a method of coupling a tension component with the helmet protective layer 502. The tension component is a strap 504 that is operable with the tension member (not shown) to apply a constrictive force to the wearer's head. The strap 504 is positioned in the forefront of the helmet protective layer 502 to apply an inward constrictive force about the forehead of the wearer.

The strap 504 is coupled with the helmet protective layer 502 by inserting opposing ends of the strap 540 through slots 506 that are formed on the helmet protective layer 502. With the opposing ends of the strap 504 inserted through the slots 506, a portion of the strap 504 is positioned on the exterior of the helmet protective layer 502 while another portion of the strap (e.g., the opposing ends of the strap 504) is positioned on the interior of the helmet protective layer 502. In some instances, the opposing ends of the strap 504 may be positioned on the exterior of the helmet protective layer 502 while a more central portion is positioned within the interior of the helmet protective layer 502.

The coupling of the strap 504 with the helmet protective layer 502 maintains the position and orientation of the strap 504 in relation to the helmet protective layer 502. In some embodiments, a central portion of the strap 504 is wider than the slots 506 to prevent the central portion of the strap 504 from being pulled through the slots 506. In another embodiment, the strap 504 includes bosses 520 that are disposed within holes 522 in the helmet protective layer 502. These designs aid in ensuring that the strap 504 maintains a proper alignment about the helmet protective layer 502 and does not shift circumferentially out of alignment relative thereto. In some instances, the helmet protective layer 502 may include relief cuts or portions 512 that enable the helmet protective layer 502 to flex or bend in a desired manner as the helmet protective layer 502 constricts about the wearer's head.

Figure 15A:
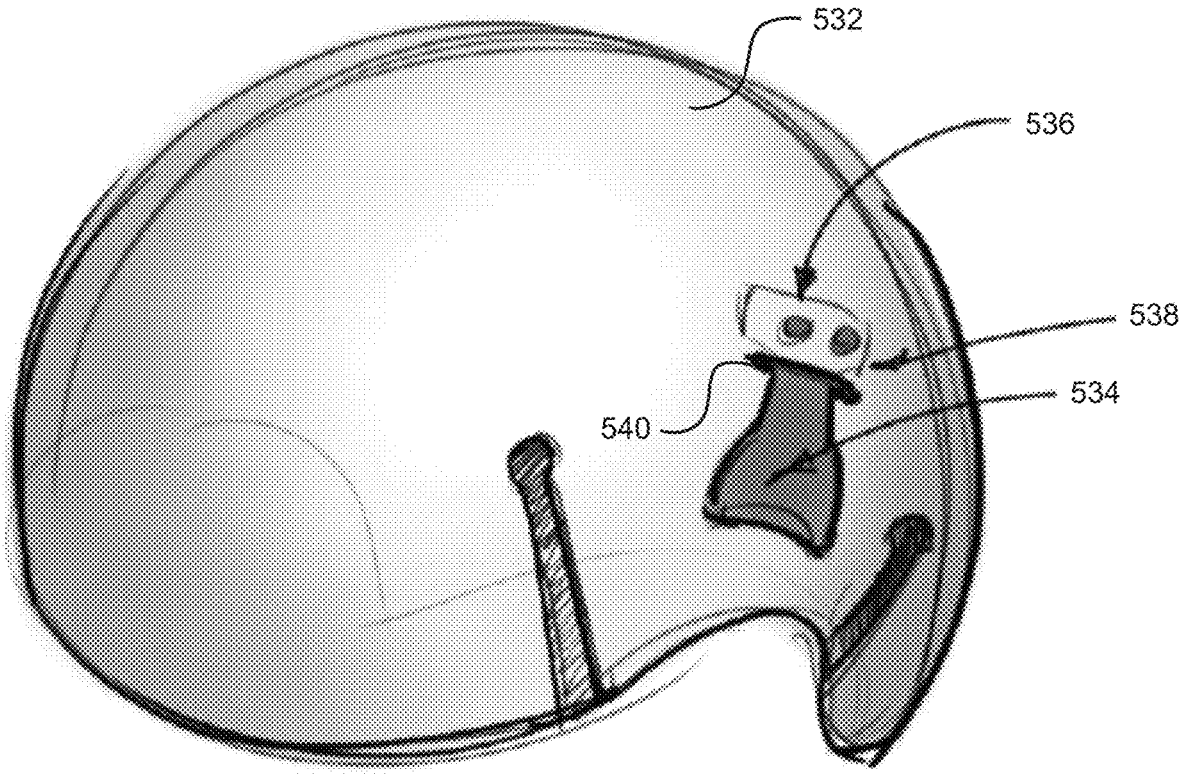
FIGS. 15A-B illustrate another embodiment of coupling a guide member with a helmet protective layer.
Figure 15B:
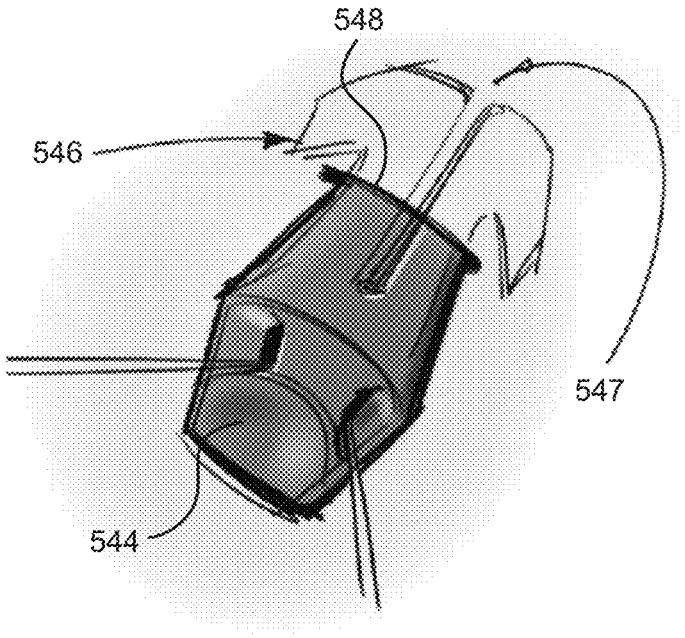

FIGS. 15A-B illustrate another embodiment of coupling a guide member with the helmet protective layer 532. In the illustrated embodiment, the guide member is an intermediate guide 534 that is positioned between the forefront and the rear portion of the helmet protective layer 532. The configuration of the intermediate guides, 534 and 544, may replace the intermediate member illustrated and described in FIG. 2B. Thus, the description of the intermediate guides, 534 and 544, are equally applicable to the embodiment of FIG. 2B.

The intermediate guide 534 is configured to guide or direct a tension member between the forefront and rear portion of the helmet protective layer 532. To couple the intermediate guide 534 with the helmet protective layer 532, a distal end of the intermediate guide 534 is inserted within a slot 540 of the helmet protective layer 532. The distal end of the intermediate guide 534 includes bosses 536, or other coupling features, that are inserted within apertures or holes 538 of the helmet protective layer 532. The insertion of the bosses 536 within the apertures 538 stabilizes the intermediate guide 534 in relation to the helmet protective layer 532.

In another embodiment, the distal end of the intermediate guide 544 may be forked or barbed 546 to allow for a one-way insertion of the distal end of the intermediate guide 544 into the slot 548 of the helmet protective layer. The barbed or forked end 546 may flex inward about a gap 547 as the intermediate guide 544 is inserted through the slot 548 and may flex outward after insertion of the intermediate guide 544 in order to lock or secure the intermediate guide 544 in position.

Figure 16A:
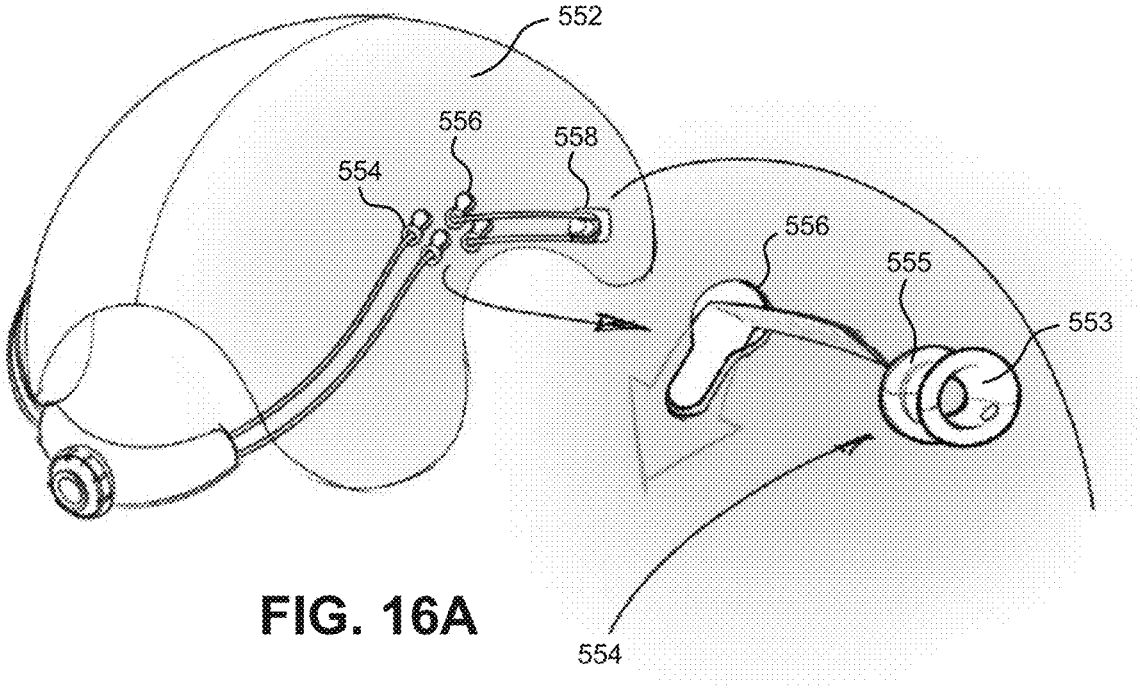
FIGS. 16A-C illustrate another embodiment of coupling guide members with a helmet protective layer.
Figure 16B:
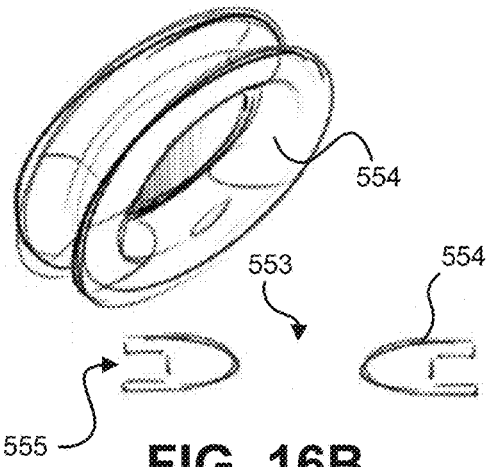
Figure 16C:
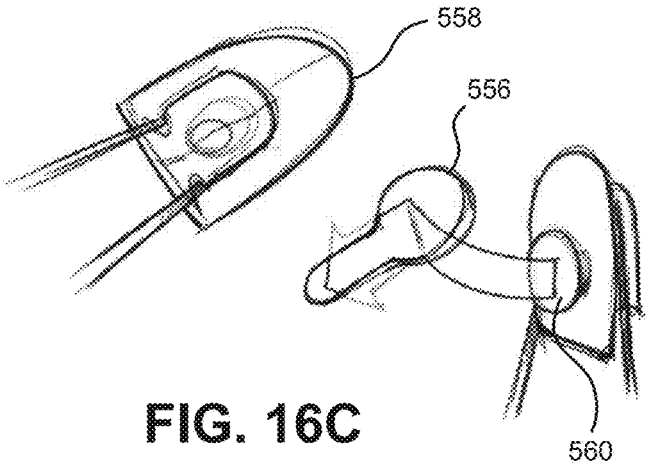

FIGS. 16A-C illustrate another embodiment of coupling guide members with the helmet protective layer 552. The guide members in FIGS. 16A-B are ring-shaped guides 554 having a central hole 553 through which the tension member is inserted. An annular channel 555 is formed in the outer surface of the ring-shaped guide 554, which allows the ring-shaped guides 554 to be inserted within an aperture 556 of the helmet protective layer 552. As illustrated, the apertures 556 include a large end that tapers into a more narrow end. The large end is shaped and sized so that the ring-shaped guide 554 may be inserted partially through the aperture 556. With the ring-shaped guide 554 inserted partially through the aperture 556, the ring-shaped guide 554 may be slid into the more narrow end of the aperture 556. The narrow end of the aperture is narrower than the ring-shaped guide 554, but is slightly larger than the annular channel 555 formed in the outer surface of the guide 554, which allows the ring-shaped guide 554 to be positioned in a secure or fixed manner in the narrow end of the aperture 556. The tension member may then be inserted through the central hole 553 of the ring-shaped guide 554. As illustrated, the ring-shaped guides 554 may be used in pairs to route or direct the tension member about the helmet protective layer 552.

FIG. 16C illustrates another guide member 558 that is used to route or direct the tension member. The guide member 558 may be a distal most guide that is positioned on or near a distal end of a path of the tension member. In some instances, the guide member 558 may include a boss 560 having an annular channel that allows the guide member 558 to be inserted within an aperture 556 and fixed or secured in the narrow end of the aperture 556 as described.

Other methods of attaching one or more components of the reel based closure system to the helmet protective layer include the use of magnets, screws, bolts, rivets, or other mechanical fasteners, or involve twisting a portion of a component of the reel based closure system to lock the component in position about the helmet protective layer.

While several embodiments and arrangements of various components are described herein, it should be understood that the various components and/or combination of components described in the various embodiments may be modified, rearranged, changed, adjusted, and the like. For example, the arrangement of components in any of the described embodiments may be adjusted or rearranged and/or the various described components may be employed in any of the embodiments in which they are not currently described or employed. As such, it should be realized that the various embodiments are not limited to the specific arrangement and/or component structures described herein.

In addition, it is to be understood that any workable combination of the features and elements disclosed herein is also considered to be disclosed. Additionally, any time a feature is not discussed with regard in an embodiment in this disclosure, a person of skill in the art is hereby put on notice that some embodiments of the invention may implicitly and specifically exclude such features, thereby providing support for negative claim limitations.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A protective component for use with a helmet or other headwear, the protective component comprising:

a liner or shell that is coupleable with the helmet or other headwear so that the liner or shell is positioned on an interior surface of the helmet or other headwear when coupled with the helmet or other headwear, wherein the liner or shell is shaped to correspond to the helmet or other headwear, the liner or shell is made of a low-friction material, and the liner or shell is coupled with the helmet or other headwear so that the liner or shell is rotatable relative to the helmet or other headwear, thereby enabling a relative motion between a wearer's head and the helmet or other headwear responsive to a force or an impact being exerted on the helmet or other headwear;

a rear support member that is removably coupleable with a rear portion of the liner or shell;

a tightening mechanism that is attached to the rear support member and that is operably coupled with a tension member, the tightening mechanism including a rotatable spool and a knob that is configured to rotate the spool, wherein rotation of the spool in a tightening direction winds the tension member about the spool to tension the tension member and thereby tighten the liner or shell about the wearer's head;

a front support member that is spaced apart from the rear support member forming a gap between the front support member and the rear support member, wherein the tension member is coupled to the rear support member and the front support member and extends across the gap between the rear support member and the front support member, and wherein tensioning of the tension member pulls the front support member toward the rear support member when tensioned; and at least one intermediate tender configured to engage the tension member and route the tension member between the front support member and the rear support member, the at least one intermediate tender including at least one guide within which the tension member is slidably positioned;

wherein the at least one intermediate tender is positioned about the liner or shell so that the at least one guide is positioned on an exterior surface of the liner or shell and so that a first portion of the at least one intermediate tender is positioned on an interior surface of the liner or shell while a second portion of the at least one intermediate tender is positioned on the exterior surface of the liner or shell.

2. The protective component of claim 1, wherein the rear support member comprises a yoke that is configured to engage the back of the wearer's head.

3. The protective component of claim 1, wherein the rear support member comprises an engagement member that is configured to couple with a corresponding engagement member of the liner or shell to couple the rear support member to the rear portion of the liner or shell.

4. The protective component of claim 3, wherein the engagement member of the rear support member comprises at least one boss or protrusion, and wherein the engagement member of the liner or shell comprises at least one aperture.

5. The protective component of claim 1, wherein the rear support member is adjustable relative to the liner or shell such that a position of the rear support member about the wearer's head is adjustable by adjusting the position of the rear support member in relation to the liner or shell.

6. The protective component of claim 5, wherein the liner or shell includes a plurality of apertures within which a boss or protrusion of the rear support member is positionable, and wherein the rear support member is adjustable relative to the liner or shell by repositioning the boss or protrusion within a different one of said plurality of apertures.

7. The protective component of claim 1, wherein the front support member comprises a forehead strap configured to engage a forehead portion of the wearer's head.

8. The protective component of claim 7, wherein the front support member comprises one or more temple guides configured to be positioned near the temples of the wearer's head.

9. The protective component of claim 1, wherein the tension member forms a single loop that extends across a right side of the liner or shell and across a left side of the liner or shell to provide a dynamic fit between the right side and the left side.

10. A protective component for use with a helmet or other headwear, the protective component comprising:

a liner or shell that is coupleable with the helmet or other headwear so that the liner or shell is positioned on an interior surface of the helmet or other headwear when coupled with the helmet or other headwear, wherein the liner or shell is shaped to correspond to the helmet or other headwear, the liner or shell is made of a low-friction material, and the liner or shell is coupled with the helmet or other headwear so that the liner or shell is moveable relative to the helmet or other headwear responsive to a force or an impact being exerted on the helmet or other headwear, wherein the liner or shell comprises:

a front support member;

a rear support member spaced apart from the front support member forming a gap between the front support member and the rear support member; and at least one intermediate tender positioned in the gap between the front support member and the rear support member;

a tension member coupled to the front support member and to the rear support member, the tension member extending across the gap between the front support member and the rear support member; and a tightening mechanism configured to adjust a tension of the tension member, the tightening mechanism comprising a rotatable spool and a knob configured to rotate the spool, wherein rotation of the spool in a tightening direction winds the tension member about the spool to tension the tension member;

wherein the at least one intermediate tender is configured to engage the tension member between the front support member and the rear support member, wherein the at least one intermediate tender comprises at least one lace guide within which the tension member slides as the tension of the tension member is adjusted, and wherein the at least one intermediate tender is positioned about the liner or shell so that the at least one lace guide is positioned on an exterior surface of the liner or shell and so that a first portion of the at least one intermediate tender is positioned on an interior surface of the liner or shell while a second portion of the at least one intermediate tender is positioned on the exterior surface of the liner or shell.

11. The protective component of claim 10, wherein the at least one intermediate tender comprises an attachment portion that is configured to couple the at least one intermediate tender to the liner or shell.

12. The protective component of claim 10, wherein the at least one intermediate tender is integrally formed with the liner or shell.

13. The protective component of claim 10, wherein the at least one intermediate tender is configured such that tensioning the tension member causes the at least one intermediate tender to move inwardly to apply a tightening force to a wearer's head.

14. The protective component of claim 10, wherein the at least one intermediate tender comprises:

a first tension member path; and a second tension member path that is separated from the first tension member path.

15. The protective component of claim 10, wherein the front support member comprises a lace guide that is positioned on a distal end of an elongate finger that is configured to wrap circumferentially around the wearer's head.

16. The protective component of claim 10, wherein the rear support member is removably coupleable with the liner or shell.

17. The protective component of claim 16, wherein the rear support member comprises a yoke that is configured to engage the back of the wearer's head.

18. The protective component of claim 17, wherein the yoke comprises an engagement member that is configured to couple with a corresponding engagement member of the liner or shell to couple the yoke to the liner or shell.

19. The protective component of claim 18, wherein the engagement member of the yoke comprises at least one boss or protrusion, and wherein the engagement member of the liner or shell comprises at least one aperture.

20. The protective component of claim 19, wherein the yoke is adjustable relative to the liner or shell such that a position of the yoke about the wearer's head is adjustable by adjusting the position of the yoke relative to the liner or shell.

21. The protective component of claim 20, wherein the liner or shell includes a plurality of apertures within which the boss or protrusion of the yoke is positionable, and wherein the yoke is adjustable relative to the liner or shell by repositioning the boss or protrusion within a different one of said plurality of apertures.

* * * * *